US006068732A

United States Patent [19]

Cassidy et al.

[11] Patent Number: 6,068,732

[45] Date of Patent: May 30, 2000

[54] MULTI-PLY PAPERBOARD WITH IMPROVED STIFFNESS

[75] Inventors: Robert F. Cassidy, Warwick; Anant D. Mahale, Chester; Dennis J. Kerstanski, Warwick; Robert V. Mahony, Greenwood Lake, all of N.Y.

[73] Assignee: International Paper Company, Purchase, N.Y.

[21] Appl. No.: 09/235,244

[22] Filed: Jan. 22, 1999

Related U.S. Application Data

[62] Division of application No. 08/916,511, Aug. 22, 1997, Pat. No. 5,916,417.

[51] Int. Cl.[7] ..... D21F 11/04

[52] U.S. Cl. ..... 162/123; 162/125; 162/129; 162/132; 428/54; 428/55; 428/56

[58] Field of Search ..... 162/111, 123, 162/125, 129, 130, 132; 428/54–55, 56, 58–59

[56] References Cited

U.S. PATENT DOCUMENTS

| | | | |
|---|---|---|---|
| 2,881,669 | 4/1959 | Thomas et al. | 92/39 |
| 3,839,143 | 10/1974 | Suckow | 162/123 |
| 4,436,587 | 3/1984 | Anderson | 162/123 |
| 4,781,793 | 11/1988 | Halme | 162/55 |
| 5,061,345 | 10/1991 | Hoffman | 162/125 |
| 5,080,758 | 1/1992 | Horng | 162/130 |
| 5,147,505 | 9/1992 | Altman | 162/129 |
| 5,169,496 | 12/1992 | Wagle et al. | 162/129 |

OTHER PUBLICATIONS

The Fractionator—A New Tool For Stock Preparation, American Paper Industry, Apr., 1972.

Technological Advantages Resulting From Fractionation Of Waste Paper, Authors: F. Fonyodi and A. Rab, EUCEPA Symposium (Oct. 23–27, 1989), pp. 209–227.

The Role Of Fractionation Of Secondary Fibers In The Production Of Cardboard, Authors: A. Rab and F. Fonyodi, Papiripar, vol. 34, No. 2, pp. 46–53, 1990.

"The Fractionator— A New . . . Preparation", API, Apr. 1972.

Fonyodi, F, "Technological . . . Waste Paper", EUCEPA Symposium, pp. 209–227, Oct. 1989.

*Primary Examiner*—Dean T. Nguyen
*Attorney, Agent, or Firm*—Luedeka, Neely and Graham, P.C.

[57] ABSTRACT

Stiffness improvements for multi-ply paperboard laid from chemically pulped softwood and hardwood papermaking furnish are obtained by fiber fractionating the softwood pulp and repositioning the resulting fractions. Chemically pulped and preferably bleached softwood fiber "rejects" of a fractionation screen are redistributed into the outer plies of a three-ply, 300–350 g/m (approximately 195 #/3,000 ft.) basis weight paperboard. The fractionation "accepts" are repositioned to the center ply for a 12% to 15% increase in Taber stiffness. The short, "accept" fiber from the fractionation screen is mixed with chemically pulped hardwood fiber or modified mechanical pulp of either species for formation of the center ply on a multiformer paper machine.

8 Claims, 27 Drawing Sheets

MULTI-PLY PAPERBOARD WITH IMPROVED STIFFNESS

This application is a division of application Ser. No. 08/916,511, filed Aug. 22, 1997 and issued as U.S. Pat. No. 5,916,417 on Jun. 29, 1999.

BACKGROUND OF THE INVENTION

The present invention relates to methods of manufacturing paperboard. More particularly, the invention relates to a paperboard manufacturing method that enables greater stiffness and strength for multi-ply paperboard of the same fiber furnish basis weight as compared to prior art methods.

Paper is manufactured by an essentially continuous production process wherein a dilute aqueous slurry of cellulosic fiber flows into the wet end of a paper machine and a consolidated dried web of indefinite length emerges continuously from the paper machine dry end. The wet end of the paper machine comprises one or more headboxes, a drainage section and a press section. The dry end of a modern paper machine comprises a multiplicity of steam heated, rotating shell cylinders distributed along a serpentine web traveling route under a heat confining hood structure. Although there are numerous design variations for each of these paper machine sections, the commercially most important of the variants is the fourdrinier machine wherein the headbox discharges a wide jet of the slurry onto a moving screen of extremely fine mesh.

The screen is constructed and driven as an endless belt carried over a plurality of support rolls or foils. A pressure differential across the screen from the side in contact with the slurry to the opposite side draws water from the slurry through the screen while that section of the screen travels along a table portion of the screen route circuit. As slurry dilution water is extracted, the fibrous constituency of the slurry accumulates on the screen surface as a wet but substantially consolidated mat. Upon arrival at the end of the screen circuit table length, the mat has accumulated sufficient mass and tensile strength to carry a short physical gap between the screen and the first press roll. This first press roll carries the mat into a first press nip wherein the major volume of water remaining in the mat is removed by roll nip squeezing. One or more additional press nips may follow.

From the press section, the mat continuum, now generally characterized as a web, enters the dryer section of the paper machine to have the remaining water removed thermodynamically.

Contemporary food and small article packaging relies heavily upon a roughly 0.009 in. caliper or greater thickness of paper broadly characterized as paperboard. Two of the more desirable qualities sought for paperboard packaging are stiffness and surface smoothness. High stiffness relates to the speed at which the paperboard may be controllably transferred through a converting machine. Surface smoothness relates to the quality of sales promotional graphics that may be transferred to the paperboard surface by traditional printing processes.

In recent years, fourdrinier machines have been developed to make paperboard having multiple, independent layers or plies of papermaking stock laid together or in closely spaced sequence along a single forming section of the fourdrinier screen circuit. What is referred to herein as layers or plies is to be distinguished from a laminated composite of independently formed solid sheet having a sharply defined interface between juxtaposed sheet surfaces. In the case of multi-ply fourdrinier-formed paper or paperboard, such as the present invention, each of the "layers" or "plies" could more accurately be described as a "zone" that transitions substantially seamlessly into the adjacent zone. The interface is not a plane but a transition zone of proportionately significant thickness wherein the fiber of adjacent zones are commingled.

Generally speaking, the most important fibers for the manufacture of paper are obtained from softwood and hardwood tree species. However, fibers obtained from straw or bagasse have been utilized in certain cases. Both chemical and mechanical defiberizing processes, well known to the prior art, are used to separate papermaking fiber from the composition of natural growth. Papermaking fiber obtained by chemical defiberizing processes and methods is generally called chemical pulp whereas papermaking fiber derived from mechanical defiberizing methods may be called groundwood pulp or mechanical pulp. There also are combined defiberizing processes such as semichemical, thermochemical or thermomechanical. Either of the tree species may be defiberized by either chemical or mechanical methods. However, some species and defiberizing processes are better economic or functional matches than others.

An important difference between chemical and mechanical pulp is that mechanical pulp may be passed directly from the defiberizing stage to the paper machine. Chemical pulp on the other hand must be mechanically defiberized, washed and screened, at a minimum, after chemical digestion. Usually, chemical pulp is also mechanically refined after screening and prior to the paper machine. Additionally, the average fiber length of mechanical pulp is, as a rule, shorter than that of chemical pulp. However, fiber length is also highly dependent upon the wood species from which the fiber originates. Softwood fiber is generally about three times longer than hardwood fiber.

The ultimate properties of a particular paper are determined in large part by the species of raw material used and the manner in which the paper machine and web forming process treat these raw materials. Important operative factors in the mechanism of forming the paper web are the headbox and screen.

The particular fiber material or stock from which the paper is manufactured is, by nature, generally highly nonhomogeneous with respect to both the length and the thickness of the fibers. The longest fibers are of an order of 2 to 3 mm, while the shortest fibers are about 1/10 of this length. Only a few paper grades are produced by using a single fiber type alone. In most cases, at least two kinds of fiber are used for paper.

In conventional practice, a multiply board such as a three-ply board for packaging stock will contain as the middle or interior ply predominately softwood fibers with at least one of the outer plies containing predominately hardwood fibers. Generally speaking, hardwood fibers provide better smoothness as compared to softwood fibers, but are more expensive. On the other hand, softwood fibers confer higher strength and stiffness than hardwood fibers at a lower cost but at the expense of surface texture and smoothness unless the softwood fiber web is augmented by expensive fillers and other additives.

Also, most paper mills, for logistical and cost reasons and in order to be able to produce a commercially competitive product, must rely upon wood sources within the geographic area of the mill. The diversity of the local pulp sources vis-a-vis the natural ratio of softwood to hardwood therefore imposes a limitation on the mix of pulp available to the mill for making multi-ply board. In mills operating in regions containing predominately softwood pulp sources, hardwood pulp must often be transported to the mill from outside the region with a resultant economic penalty.

It is therefore an object of the present invention to provide a method for making multi-ply paperboard and, particularly, a three or more ply paperboard.

Another object of the invention is to reduce the total quantity of fiber per unit of web area (basis weight) in a multi-ply paperboard without a reduction in the web stiffness or caliper.

Also an object of the present invention is a balanced, three-ply paperboard of superior stiffness and surface texture.

An additional object of the present invention is a balanced, three-ply paperboard of superior stiffness and surface texture which can be produced economically using existing papermill equipment.

Still another object of the present invention is to enable production of multi-ply paperboard exhibiting improved properties with a reduction in total sheet weight at the same sheet stiffness.

SUMMARY OF THE INVENTION

With regard to the foregoing and other objects as will subsequently become apparent from the following detailed description of the invention, the invention is directed to a method of making a multi-ply paperboard sheet and a corresponding product which includes a constituency of chemically pulped softwood and hardwood fiber. A center ply of the multi-ply composite comprises about 40% to about 60% of the total fiber in the sheet. The remaining fiber of the sheet is substantially divided between a pair of opposite surface plies. The method includes the step of segregating (fractionating) the chemically pulped softwood fiber constituent of the sheet into a short fiber fraction and a long fiber fraction. A first papermaking furnish includes the long fiber fraction whereas a second papermaking furnish includes a mixture of the short fiber fraction and the chemically pulped hardwood fiber constituency. The sheet center ply is formed from the second papermaking furnish and the sheet surface plies are formed from the first papermaking furnish.

Other embodiments and aspects of the invention include the mixture of modified mechanical pulp with the second papermaking furnish, up to and including about 50% of the center ply constituency.

Another embodiment of the invention includes fractionation of the softwood prior to bleaching and mixing the short fiber fraction with unbleached hardwood for a combined hardwood/softwood bleach line. Bleached modified mechanical pulp may be mixed with the post bleach plant flow of the combined hardwood/softwood flow stream.

BRIEF DESCRIPTION OF THE DRAWINGS

The following detailed description of the present invention includes reference to the several figures of the drawings wherein like reference characters designate like or similar elements throughout the several figures and wherein.

DESCRIPTION OF THE PREFERRED EMBODIMENTS

Figure 1:
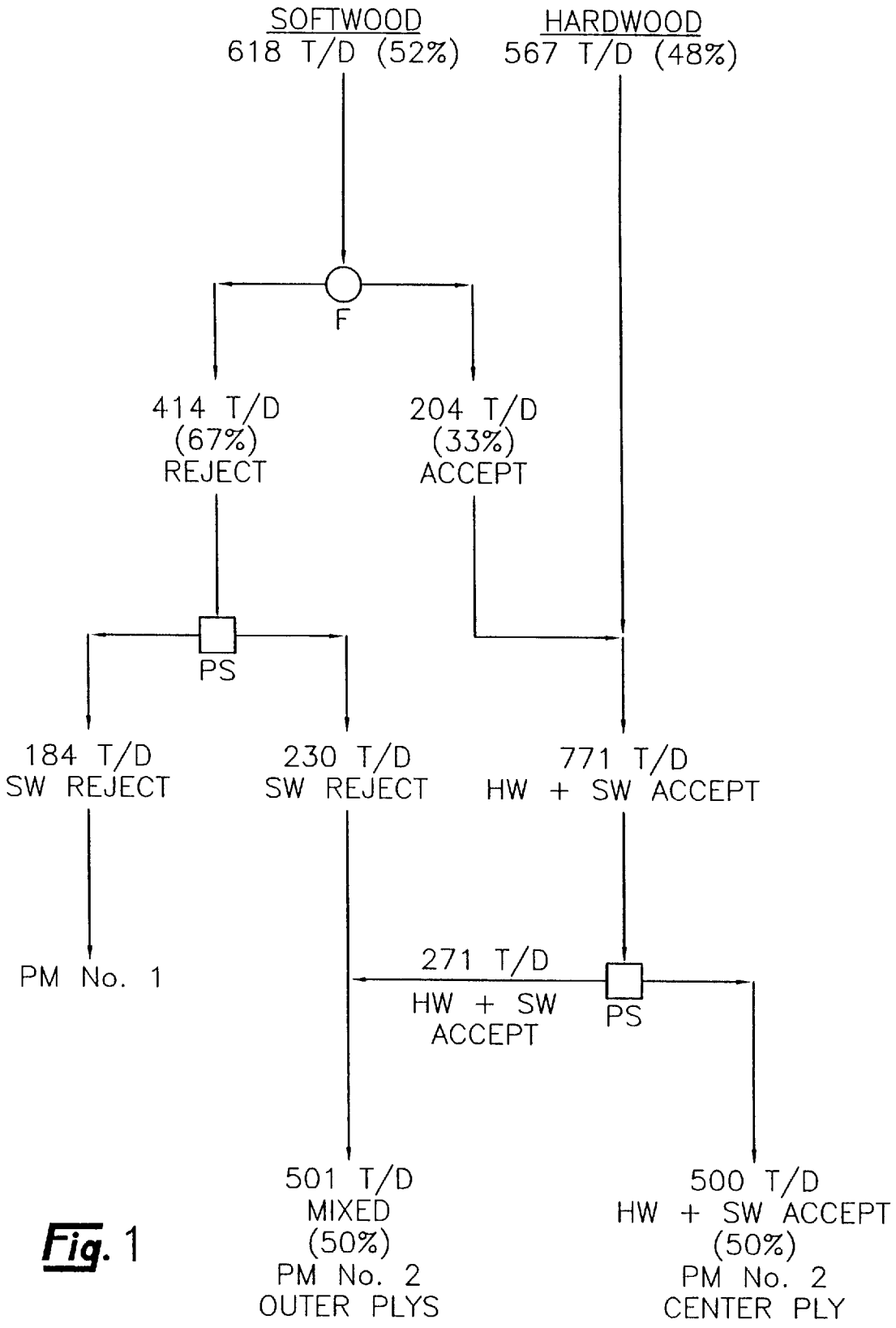
FIG. 1 is a schematic flow diagram representative of one embodiment of the invention.

Chemical pulp is the product of a thermochemical digestion process whereby wood chips are combined, in a pressure vessel, with lignin reactive chemical compounds such as an aqueous solution of sodium hydroxide, sodium sulfide and sodium sulfate and heated with steam. Over an interval of roughly 0.5 to 4.0 hours under pressures that may exceed 350 psi, the natural lignin binder of the plant cells is substantially hydrolyzed. Such lignin normally represents about 50% of the dry wood mass.

Removal of substantially all of the lignin naturally present in wood generally represents an approximately 50% fiber yield. Removal of only half of the lignin typically represents an approximately 75% yield.

The presence of some lignin in paper contributes to the composite strength and stiffness but colors the paper brown to a degree corresponding to the lignin quantity remaining. To complete a desired separation of individual wood fibers from the lignin binder system and from each other, the "cooked" product of the digester is further processed through mechanically shearing "defiberizers." The defiberized pulp stock is thereafter subjected to one or more stages of washing and screening. If white or brighter paper is desired, the pulp stock is bleached in the chemical presence of chlorine, a chlorine compound or a strong oxidant such as oxygen or ozone.

Before paper machine formation, the pulp is usually "beaten" or "refined" to break microscopic fibrils or hairs from the individual cellulose cells. When the web is formed, these fibrils mesh to amplify the number of hydrogen bonding sites between the fibers thereby contributing to the tensile and tear strength of the web. Chemical pulp is generally refined regardless of whether it is or is not bleached.

Mechanical pulp is produced by mechanically cutting or abrading natural wood into fiber size particles. For many uses and applications, mechanical pulp is further modified by abbreviated thermal and/or chemical treatments to remove 10% to 30% of lignin derived extractives and volatiles for an 85% to 95% pulp yield. Due to the significantly greater lignin content, mechanical pulp is bulkier and of inherently greater stiffness. Bulkiness is a density value which describes weight per unit volume. Stiffness is a property which relates to converting machine operating speed. Stiffer paperboard translates to a faster converting rate and sheet conveyor transfer speed.

In connection with the present invention, fractionation is a specialized form of fiber screening whereby a dilute aqueous slurry of pulp stock is flow directed over a support surface having a dense array of circular perforations. The perforations are sized to pass fiber of a predetermined length or less which are characterized as "accepts". Fiber of greater than the predetermined length pass over the perforations. The longer fiber is characterized as "reject". The exact perforation size is fiber species dependent and usually specified as a percentage of accepts. Accordingly, a fractionator may be selected to accept 30% to 40% of the total flow stream which means that the perforation is sized to pass or "accept" that fiber length or less representing the smallest or shortest fiber percentile, e.g. 30% to 40% of the total fiber flowing onto the fractionator table. The "accept" will pass through the perforations whereas the rejects will pass over the perforations. In distinction from the circular perforations of the above described fractionation screens, slot screens and wire mesh screens are more shape selective than fiber length selective. Such shape selective screens are effective for isolating and removing knots, shives and other such shape distinctive contaminants in the pulp flow stream.

A first embodiment of the invention is represented by the schematic of FIG. 1. Both softwood and hardwood fiber sources for the invention are chemically pulped by a sodium hydroxide, sodium sulphate/sulfide based process known as "kraft". In this case, the kraft pulp is bleached. The average total production of this representative pulp mill is about 1185 Tons/Day by a contribution of 618 T/D of softwood bleached kraft and 567 T/D of hardwood bleached kraft. Separation of the species is maintained through the bleaching process. Following bleaching, the softwood fiber is fractionated between a 33% relatively short fiber accept portion and a 67% relatively long fiber rejects portion. As a result, fractionation of the softwood kraft pulp produces 204 T/D of short fiber accept and 414 T/D of long fiber rejects. The 204 T/D of softwood accept is mixed with the 567 T/D of bleached kraft hardwood for a 771 T/D flow stream of short fiber available for multi-ply board production.

The softwood long fiber rejects is parceled between 184 T/D for the speciality product of another papermachine and the balance of 230 T/D is used for multi-ply board production. In this particular example, the multi-ply board includes three-plies formed as a total web basis weight of 195 #/3000 ft.$^2$ About half of the weight of the web fiber is made up of the middle or core ply and the remaining fiber weight is substantially equally divided between the two outer plies. To achieve this fiber balance, 271 T/D of the hardwood and softwood accept mixture is diverted from the 771 T/D flow stream by a simple pipe flow split and mixed with the 230 T/D softwood rejects stream for a 501 T/D outer ply flow stream of mixed fiber including softwood accepts, softwood rejects and hardwood. Deduction of the 271 T/D flow of mixed hardwood and softwood accepts from the 771 T/D flow stream leaves 500 T/D of mixed hardwood and softwood accept for center ply formation.

Performance studies of the foregoing multi-ply board furnish used two levels of control. The first control labeled "control A" for the first data column from the left of TABLE I used unfractionated softwood kraft pulp. The second control labeled "control B" fractionated the softwood fiber and thereafter remixed it in the original proportions. Theoretically, performance properties of Control A board samples should match the properties of Control B samples. However, this was not the case for all properties as may be noted from a comparative analysis of the TABLE I data.

TABLE I

| | | | SAMPLE | | | | | | |
|---|---|---|---|---|---|---|---|---|---|
| | | | CONTROL A | 1 | 2 | CONTROL B | 3 | 4 | 5 |
| CHARACTERISTIC | TOP/ BOTPLY | Softwood, % | 60 | 60 | 60 | 60 | 60 | 60 | 60 |
| | | Accepts, % | 0 | 30 | 25 | 20 | 15 | 7.5 | 0 |
| | | Rejects, % | 0 | 30 | 35 | 40 | 45 | 52.5 | 60 |
| | | Hardwood, % | 40 | 40 | 40 | 40 | 40 | 40 | 40 |
| | CENTER PLY | Softwood, % | 30 | 30 | 30 | 30 | 30 | 30 | 30 |
| | | Accepts, % | 0 | 0 | 4.5 | 10 | 15 | 22.5 | 30 |
| | | Rejects, % | 0 | 30 | 25.5 | 20 | 15 | 7.5 | 0 |
| | | Hardwood, % | 70 | 70 | 70 | 70 | 70 | 70 | 70 |
| TEST | Taber MD | | 254 | 240 | 251 | 262 | 263 | 275 | 285 |
| | Taber CD | | 94 | 89 | 91 | 98 | 103 | 107 | 108 |
| | Caliper | | 17.7 | 17.8 | 17.7 | 17.7 | 18.2 | 17.9 | 18.1 |
| | Density | | 0.77 | 0.76 | 0.76 | 0.77 | 0.75 | 0.76 | 0.75 |
| | Bas. Wt AD | | 210 | 210 | 210 | 212 | 211 | 210 | 213 |
| | Burst Fact | | 58 | 57 | 56 | 55 | 51 | 53 | 52 |
| | Break L MD | | 9.3 | 8.7 | 8.6 | 8.4 | 8 | 8.2 | 8.4 |
| | Break L CD | | 3.8 | 3.6 | 3.4 | 3.4 | 3.5 | 3.3 | 3.3 |
| | Stretch MD | | 6.6 | 6.8 | 6 | 6 | 6.3 | 5.9 | 5.8 |
| | Stretch CD | | 8.3 | 8.2 | 7.6 | 7.2 | 6.8 | 7.3 | 7.1 |
| | TEA MD | | 7.6 | 7.3 | 6.4 | 6.3 | 6.4 | 6 | 6.2 |
| | TEA CD | | 4.2 | 3.9 | 3.5 | 3.3 | 3.2 | 3.3 | 3.2 |
| | Parker IS | | 7.1 | 7 | 7 | 7.1 | 7.2 | 7 | 7.1 |
| | Parker NS | | 7.3 | 7.2 | 7.1 | 7.1 | 7.1 | 7.1 | 7.1 |
| | Gur Stif MD | | 12.1 | 10.7 | 11 | 11.6 | 11.2 | 12.5 | 12.7 |
| | Gur Stif CD | | 5.3 | 4.6 | 5.3 | 5.6 | 5.7 | 5.1 | 6.3 |
| | Tear F MD | | 105 | 110 | 107 | 102 | 103 | 100 | 93 |
| | Tear F CD | | 178 | 175 | 164 | 174 | 171 | 165 | 161 |
| | ZDT | | 95 | 84 | 76 | 83 | 70 | 69 | 68 |

Fractionated pulp for the samples used to develop the TABLE I data was prepared by a Bird Centrisorter Model 100 adjusted to yield about two-thirds long fiber rejects pulp and about one-third short fiber accept pulp. Samples of three-ply board were formed using a Formette Dynamique sheet former.

From TABLE I, it is first to be noted that the two control samples A and B did not agree with each other in all properties. The stiffness values, tear resistance, and sheet roughness agreed to within 10%. Moreover, the calipers, basis weights, and sheet densities also substantially agreed between the two control samples thereby tending to verify that the respective pressing and densification conditions were substantially the same. However, the bonding-dependent strength properties of breaking length, burst factor, stretch, tensile energy absorption and internal bond (z-direction tensile) of the remixed control sample B mostly fell 10% to 20% below the corresponding values of the control sample A made with unfractionated softwood kraft pulp.

All of the TABLE I sample pulps were refined to constant freeness in the range of 500 to 550 ml. However, the screened pulps were refined separately while all the components of the unscreened pulp were necessarily refined together to the target freeness. Separately refined pulps often yield different properties in comparison with pulps that are refined together. This difference in the refining environment might explain the observed discrepancies in the bonding properties of these two control samples.

Recognition of the discrepancies is important to the determination of whether changes in some of the properties of the redistributed fiber samples are significant. As the most important example, the Z-direction (internal) bond strengths of the redistributed fiber samples are not significantly lower than those of the remixed control sample B. However, all of these values, including the remixed control sample B, are below the internal bond strength of the unscreened control sample. Since only internal bond strength of the unscreened control sample A is anomalously high, it may therefore be concluded that there is no appreciable loss of internal bond strength due to fiber redistribution. If fiber redistribution had lowered the internal bond strength of all the samples, it would be necessary to consider a deficiency in the application of fractionation technology to board manufacture. Such discrepancies will be noted as they appear in the following discussions of the various properties.

Figure 2:
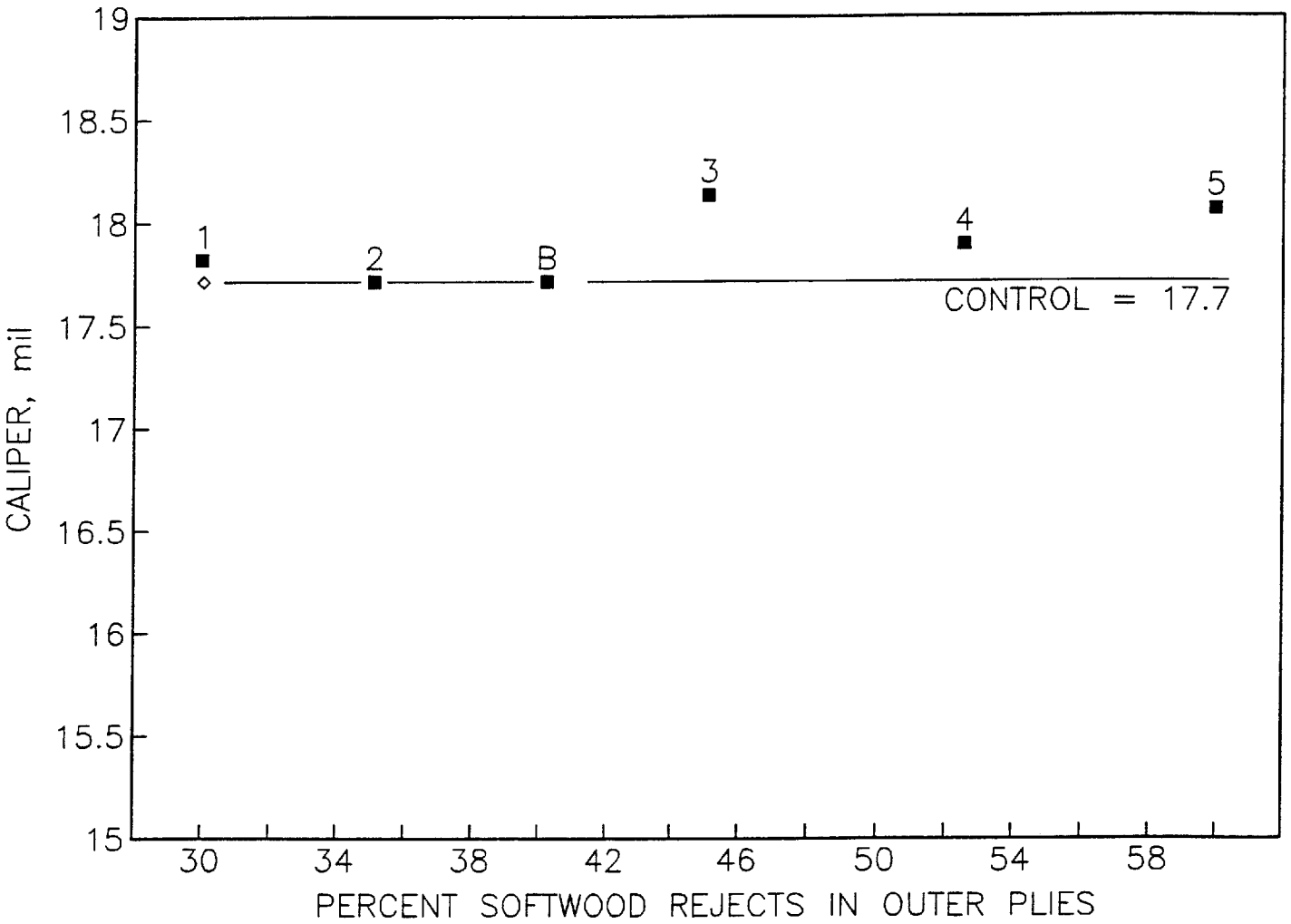
FIG. 2 is a point chart correlating Table I test sample sheet calipers to outer ply percentages of fractionated softwood rejects.

With respect to sheet caliper data represented graphically by FIG. 2, all of The TABLE I sample sheets were pressed and calendered to a nominal caliper of 0.018 in. The actual thicknesses of the sheets were not significantly different from the target value, based on the standard deviations of the individual tests. Moreover, there was no significant trend toward increasing or decreasing thickness as the fiber placement varied. The two control samples A and B showed the same caliper.

Figure 3:
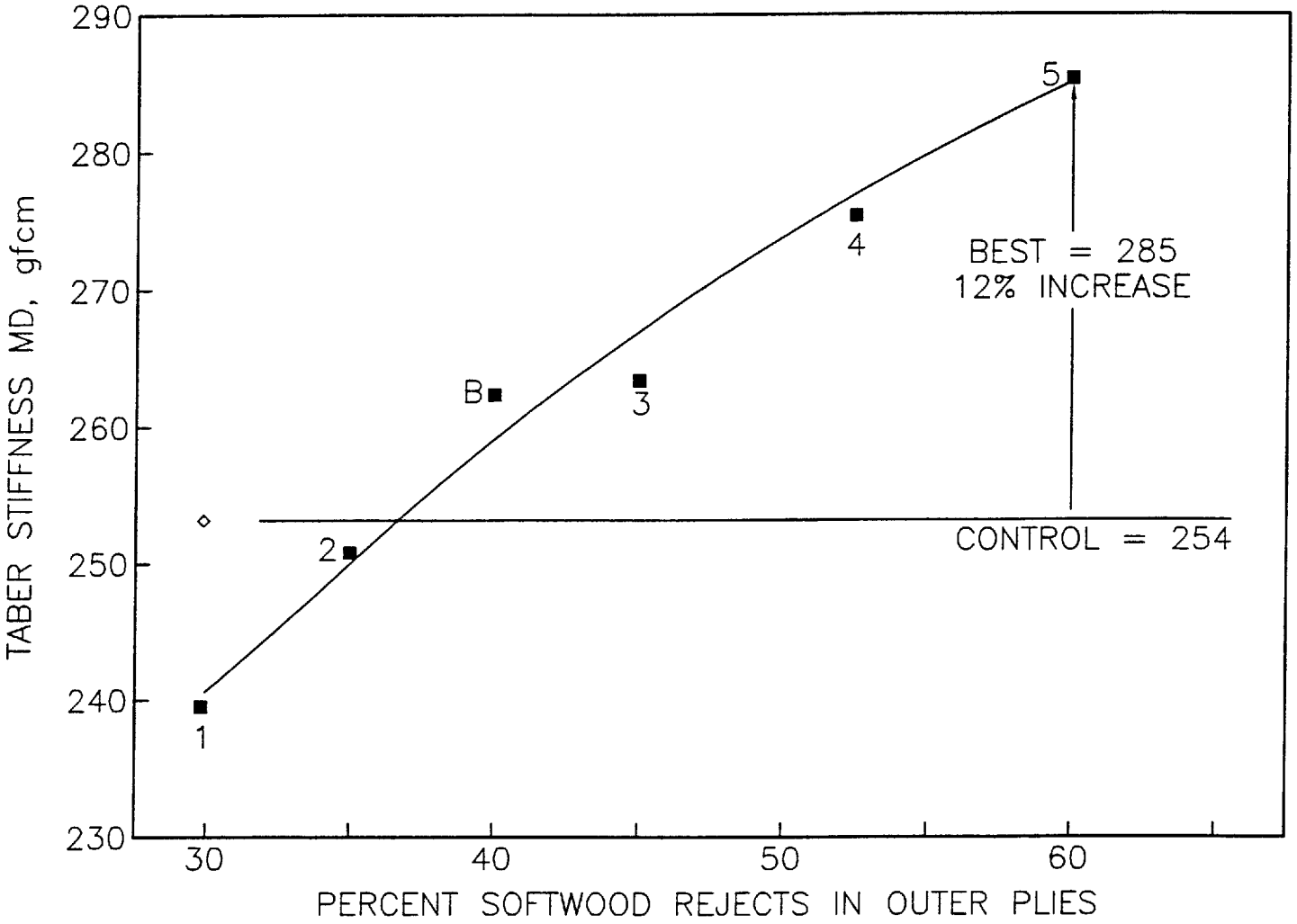
FIG. 3 graphs the correlations between the percentages of fractionated softwood rejects in the outer plies of a three-ply sheet vs the Machine Direction (MD) Taber Stiffness values respective to the test samples of Table I.
Figure 4:
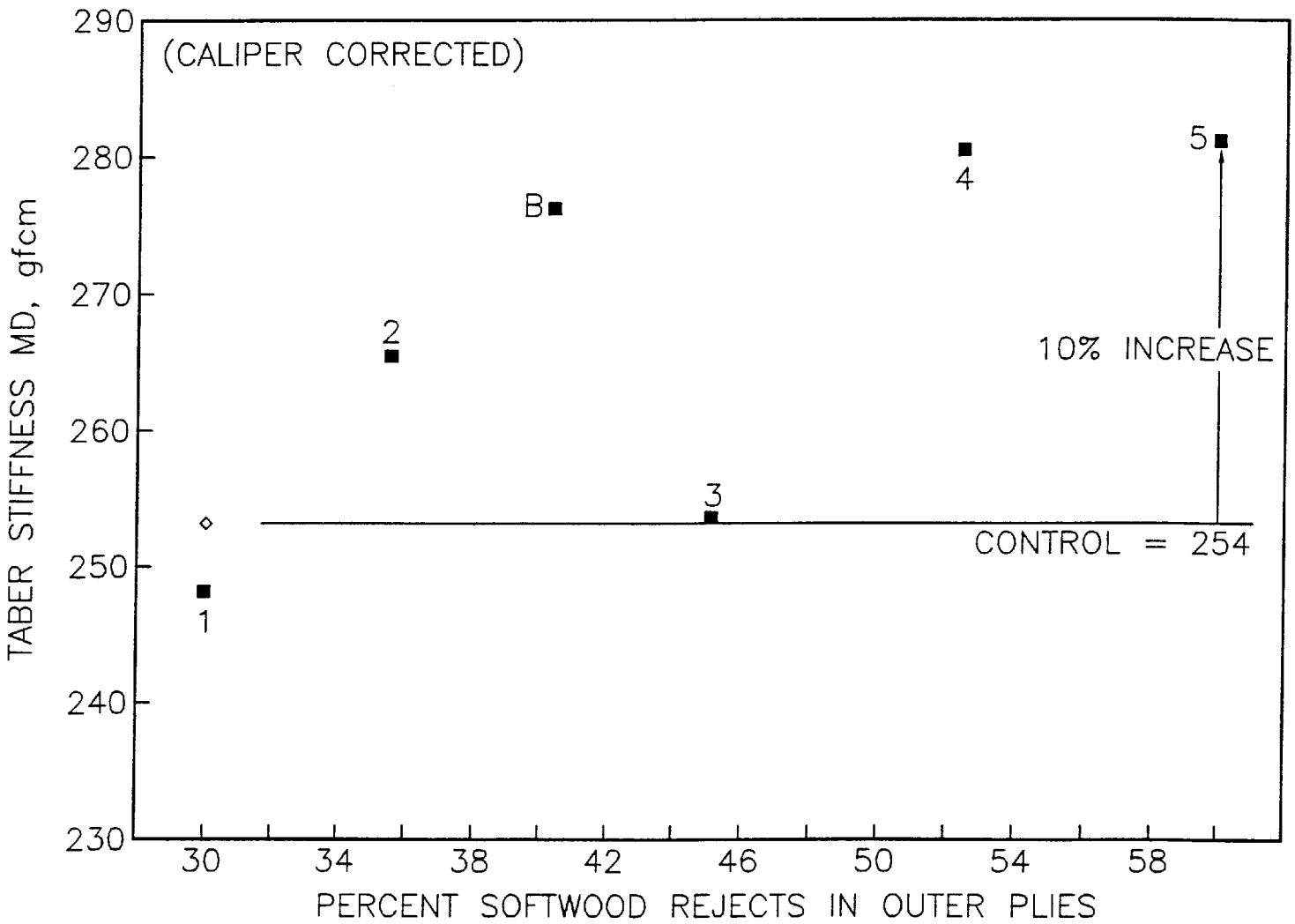
FIG. 4 graphically describes caliper normalized data of Table I with respect to the percentage of fractionated softwood rejects in the outer plies of the three-ply sample sheets vs the MD Taber Stiffness.
Figure 5:
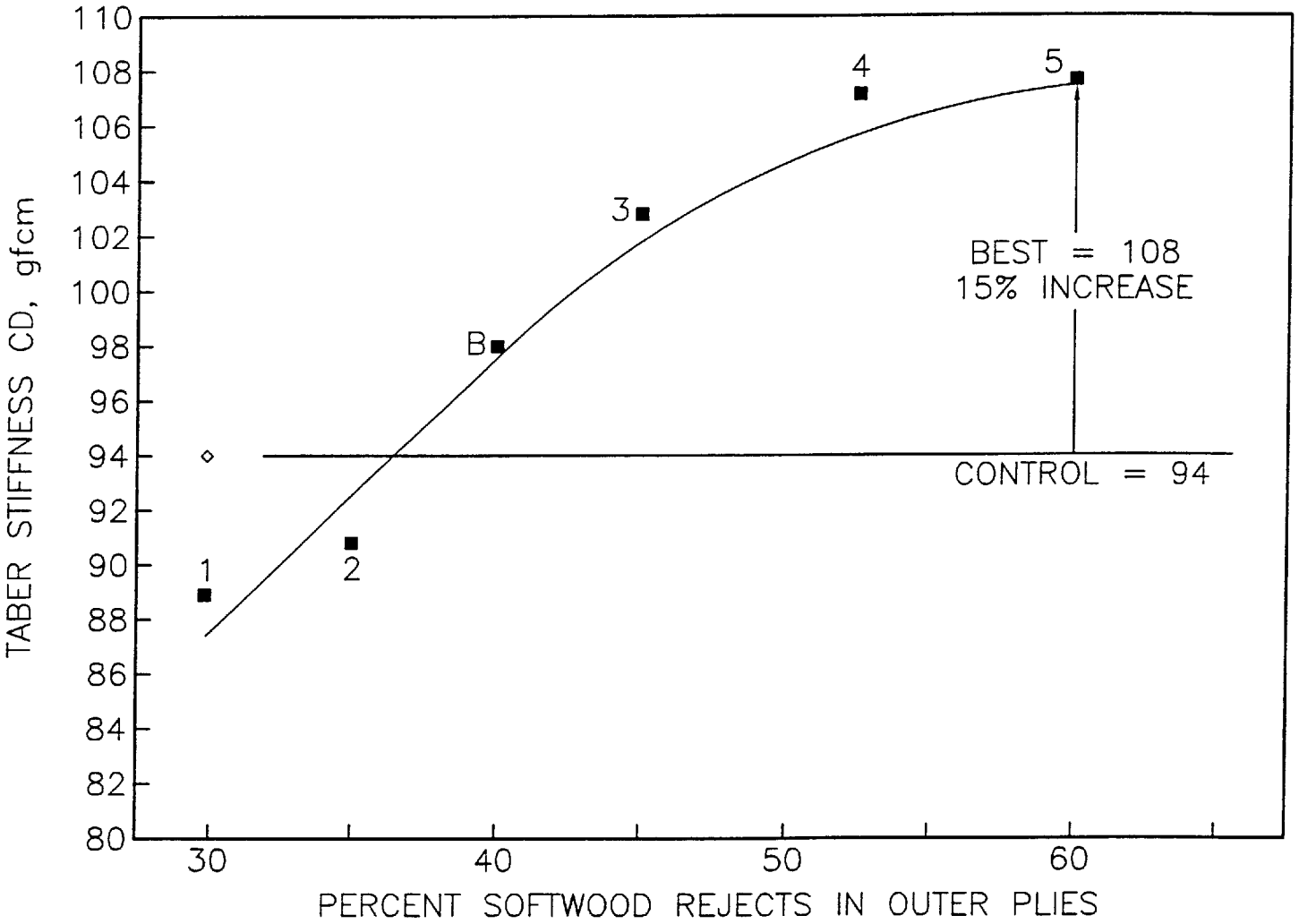
FIG. 5 graphs the correlations between percentages of fractionated softwood rejects in the outer plies of three-ply sheets to the CD Taber stiffness values respective to the test samples of Table I.
Figure 6:
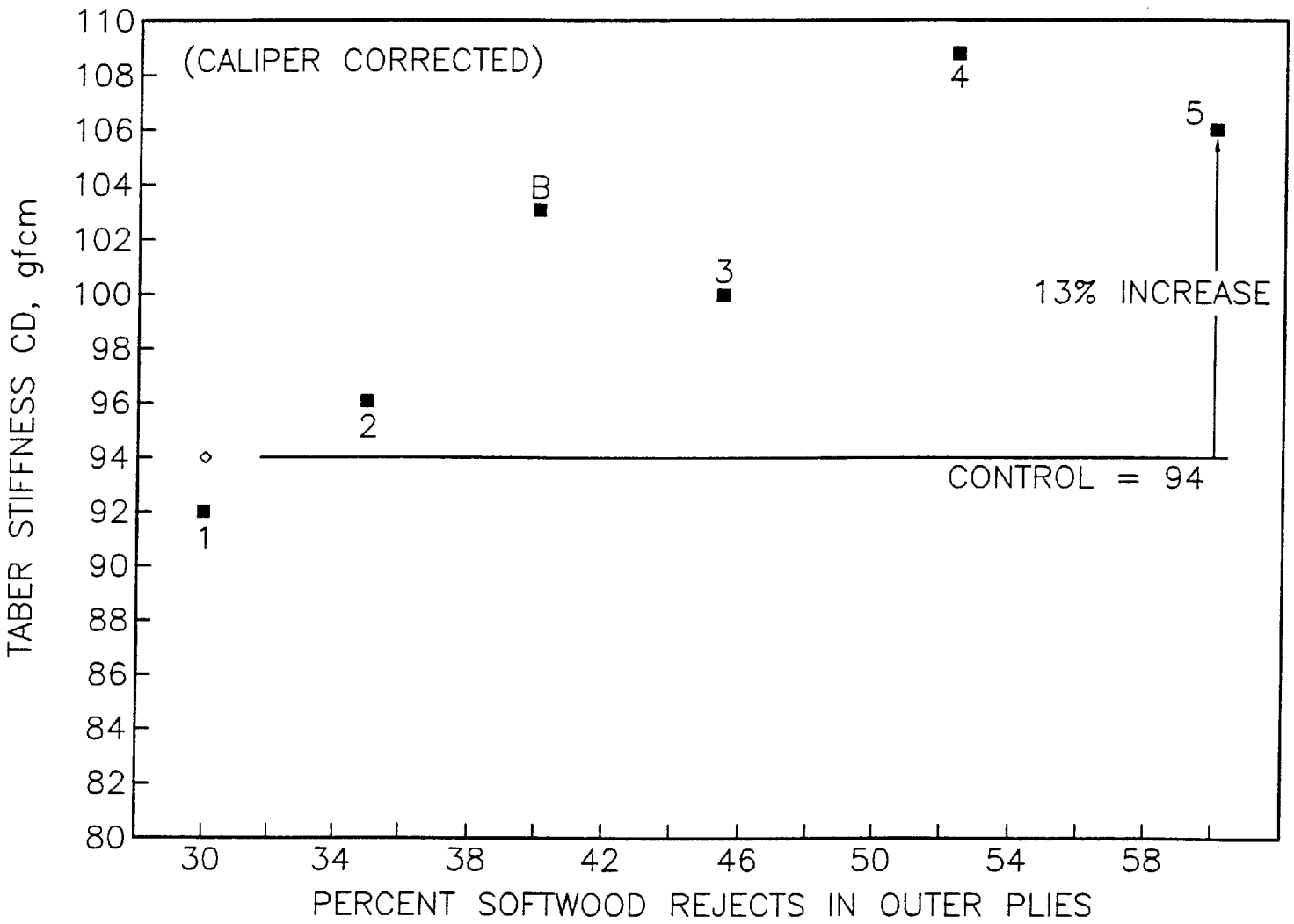
FIG. 6 graphically describes the caliper normalized data of Table I with respect to the percentage of fractionated softwood rejects in the outer plies of three-ply sample sheets vs the CD Taber stiffness.

The Taber stiffness values of TABLE I are shown graphically by FIGS. 3 AND 5. Substantial and significant increases in Taber stiffness occurred as the percentage of softwood rejects fiber was moved into the outer plies and the percentage of softwood accept fiber moved into the center ply. In the machine direction (MD) (FIG. 3), the stiffness increased by 12%, from a control value of 254 up to 285. In the cross-machine direction (CD) (FIG. 5), stiffness increased by 15%, from 94 to 108. The trends toward increasing stiffness as softwood rejects fiber was moved into the outer plies and softwood accept fiber moved into the center ply were significant for the sets of measurements in both directions. Mathematical correction for the small changes in caliper, shown by FIG. 4 for the MD values and FIG. 6 for the CD values, still showed trends toward increasing stiffness. The remixed control sample B showed insignificantly greater stiffness (3% in the MD and 4% in the CD) than the unscreened control sample A.

Figure 7:
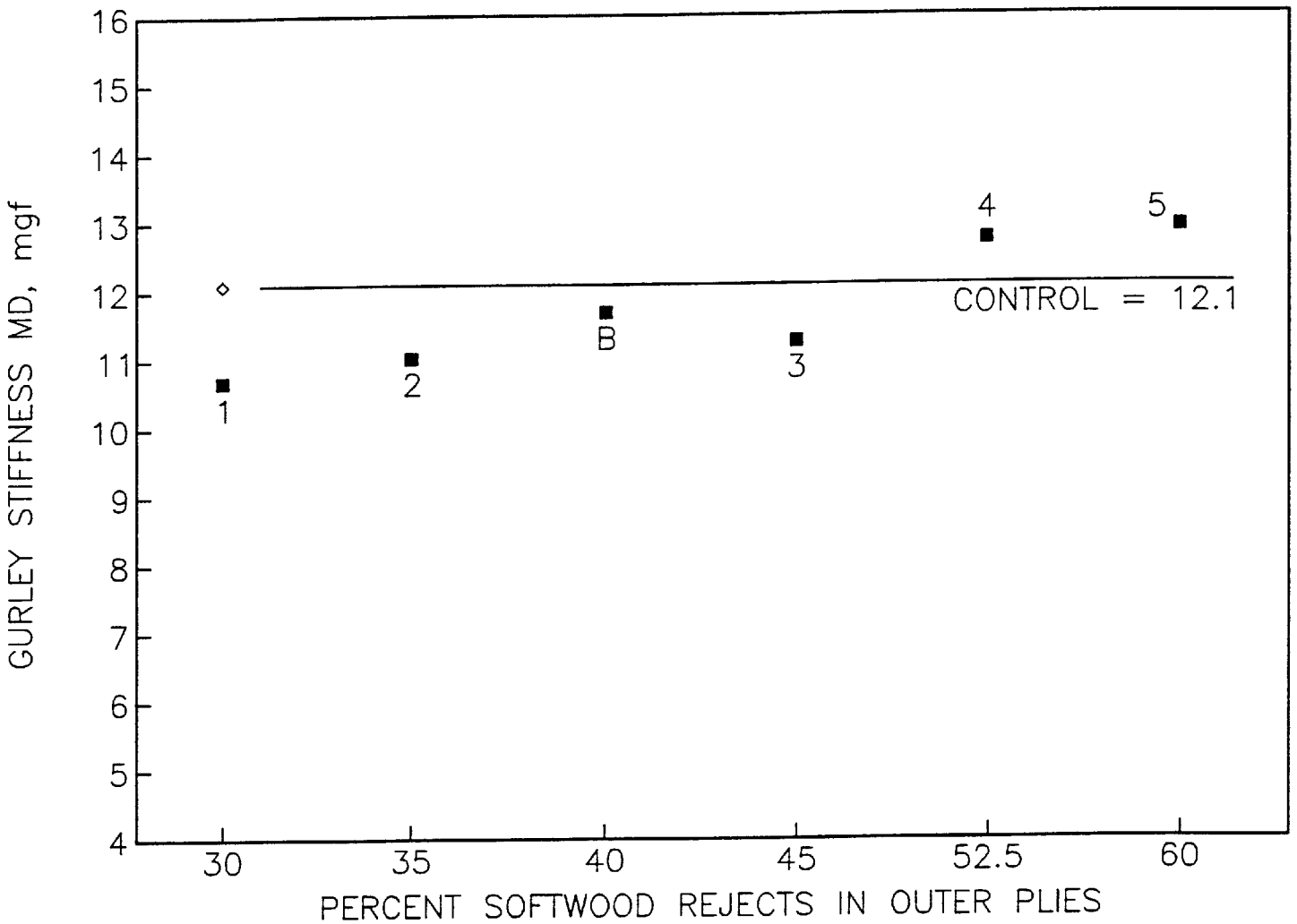
FIG. 7 is a point graph describing the MD Gurley stiffness values vs fractionated rejects content for the test samples of Table I.
Figure 8:
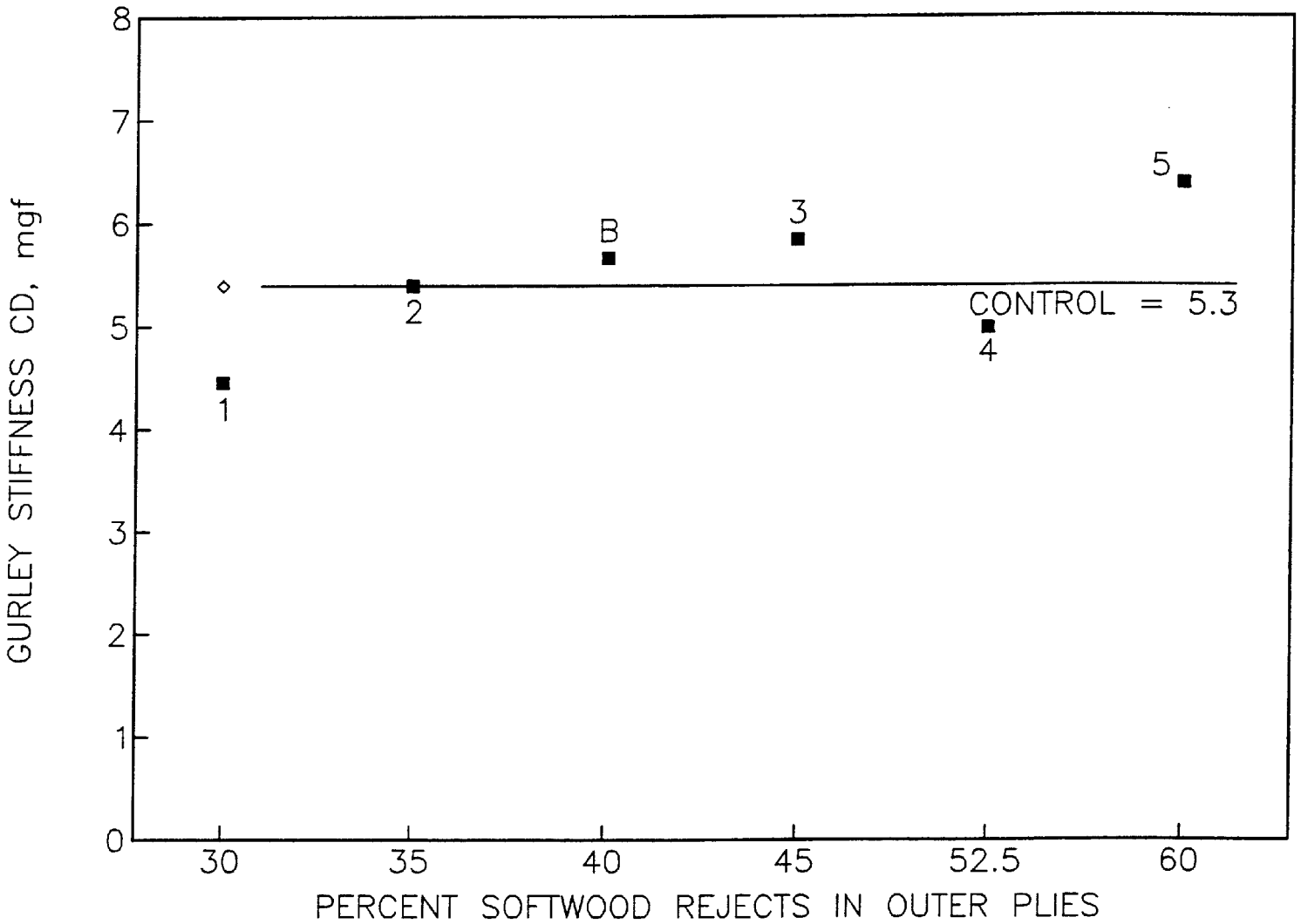
FIG. 8 is a point graph describing the CD Gurley stiffness values vs fractionated rejects content for the test samples of Table I.

The Gurley stiffness values in the machine direction illustrated by FIG. 7 confirm the trend shown in the Taber tests toward increasing stiffness in correspondence with increased softwood reject fiber in the outer plies and increasing accept fiber in the center ply. In the cross-machine direction, however, shown by FIG. 8, the apparent trend of cross-machine Gurley stiffness toward higher values is not statistically significant. Thus, the Gurley CD stiffness data agree with, but do not confirm, the trend in the CD Taber stiffness shown by FIG. 6.

Figure 9:
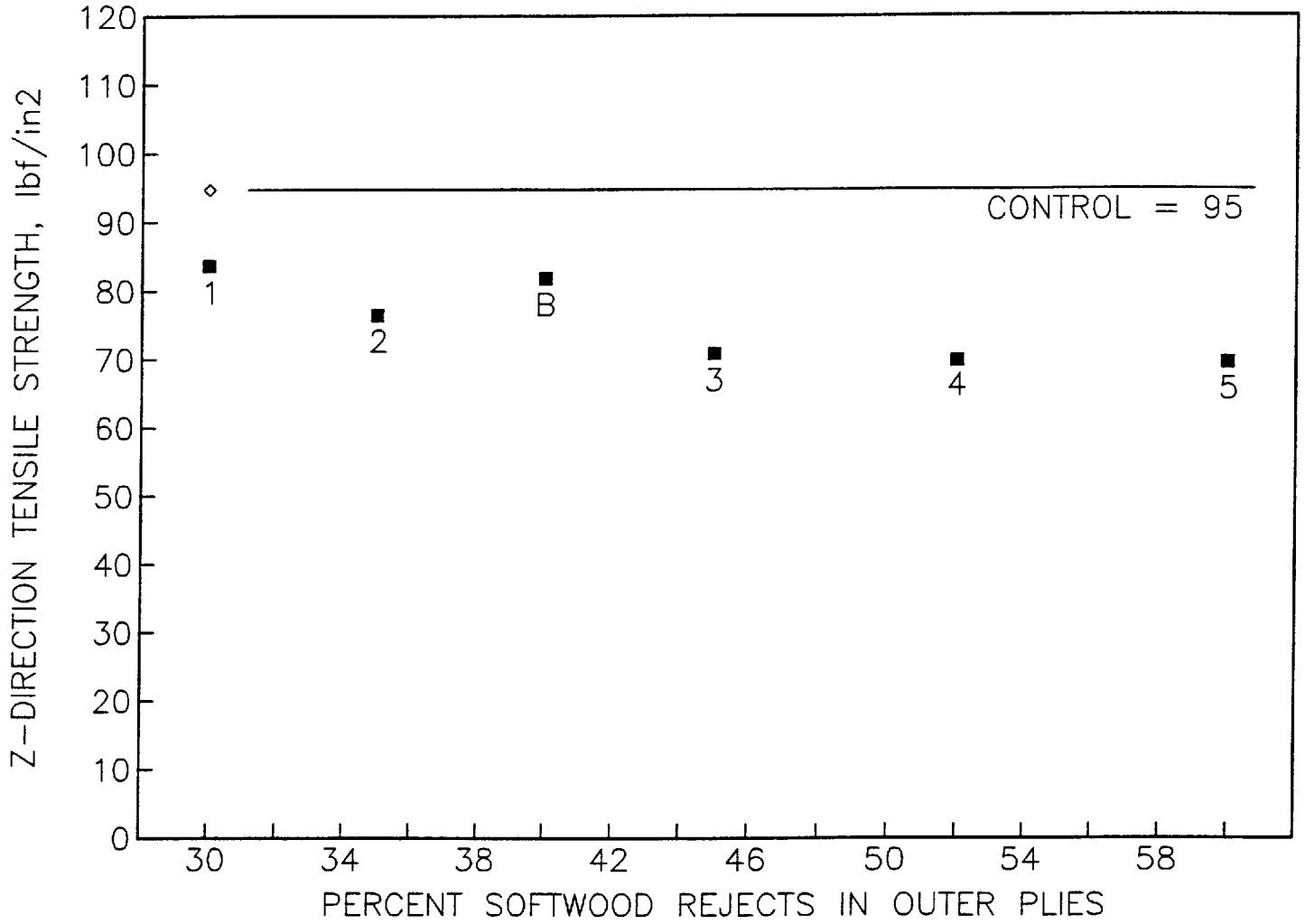
FIG. 9 is a point graph describing the Z-Direction tensile strength vs fractionated rejects content for the test samples of Table I.

FIG. 9 graphs the internal bond strength data of the sample sheets which is measured as Z-direction tensile strength, ZDT. These values decreased roughly in proportion with the degree to which the stiffer fractionation screen rejects fibers were moved into the outer plies and accept fiber moved into the center ply. Compared with the unscreened control sample A having a ZDT value of 95, the sheet containing the greatest degree of fiber redistribution and the highest degree of stiffness had a ZDT value of only 68, corresponding to a 28% decrease in internal bond strength. The remixed control sample B internal bond strength of 83 was 13% lower than the internal bond strength of the unscreened sample A. Depending on which control sample was the valid one, the decrease in internal bond strength was either insignificant or significant but not critical.

Figure 10:
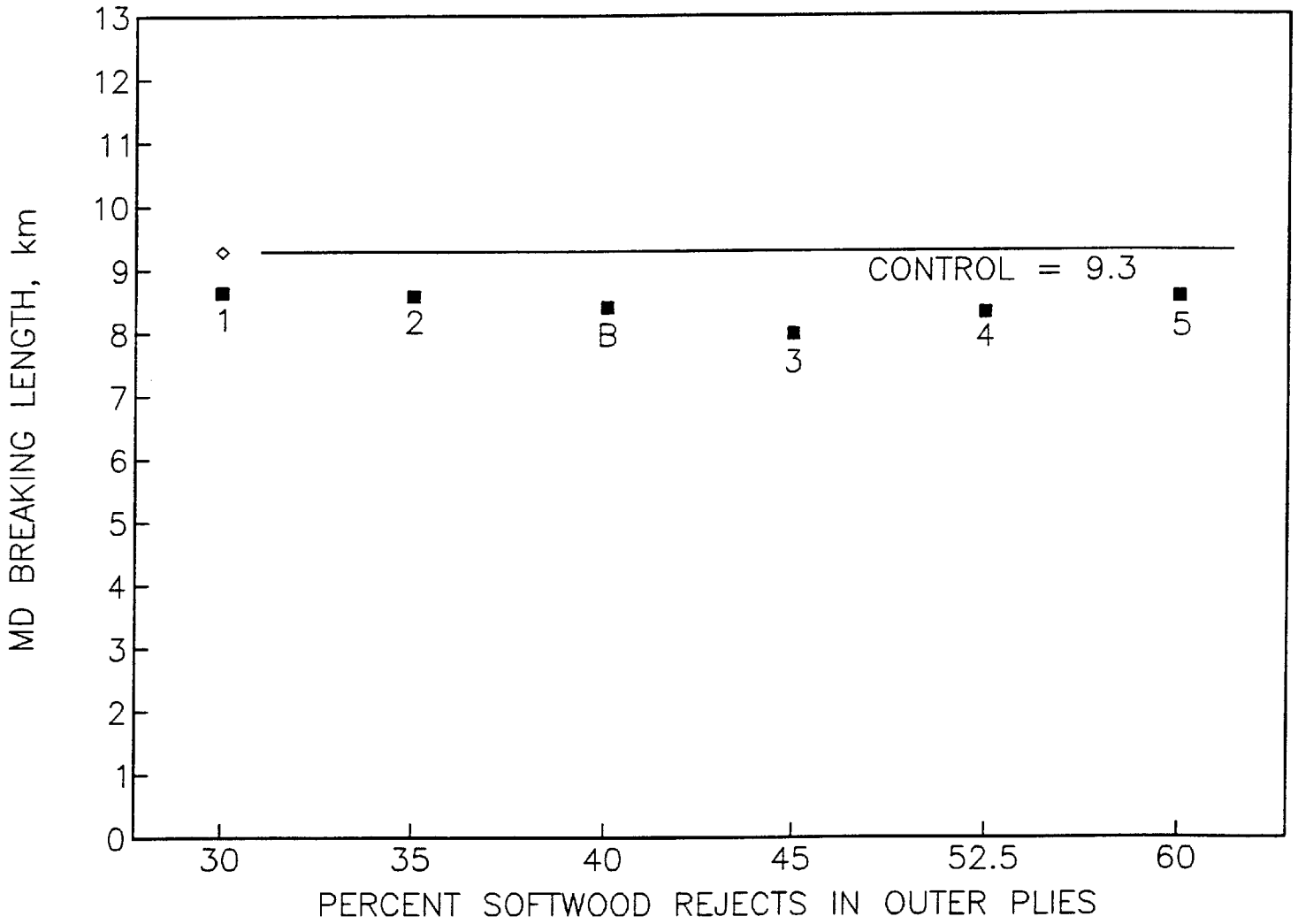
FIG. 10 is a point graph describing the MD fiber breaking length vs fractionated rejects content for the test samples of Table I.
Figure 11:
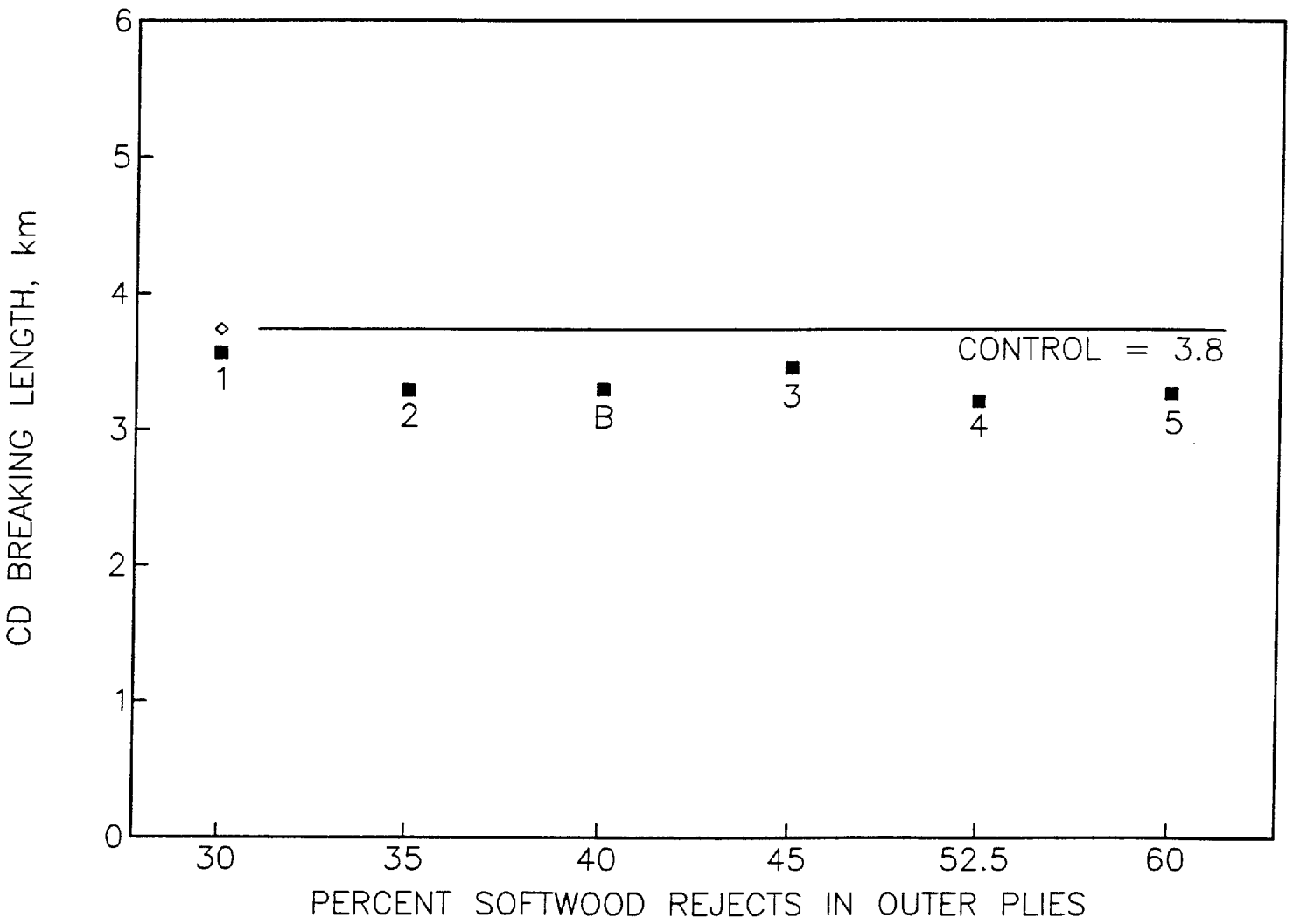
FIG. 11 is a point graph describing the CD fiber breaking length vs fractionated rejects content for the test samples of Table I.
Figure 12:
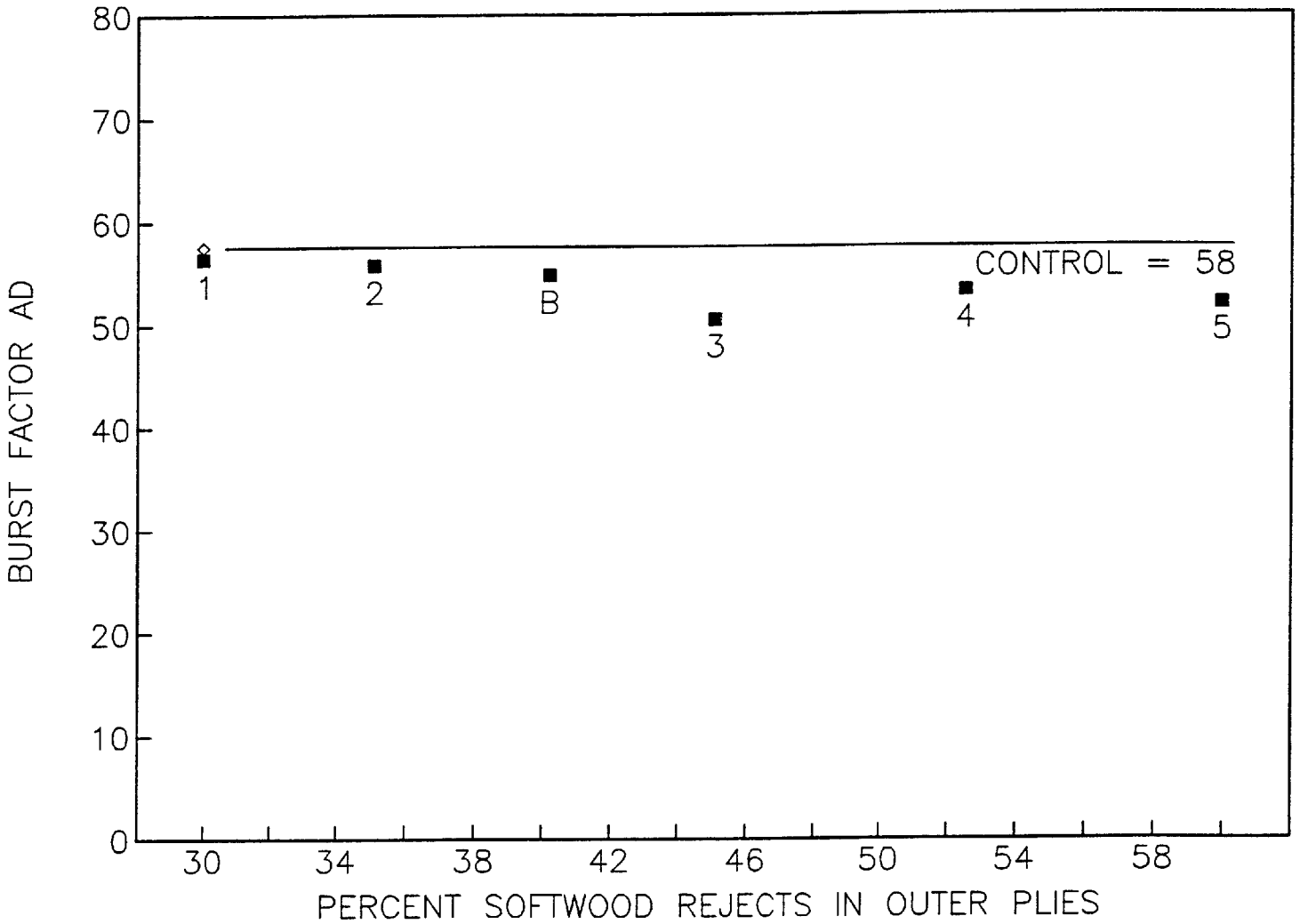
FIG. 12 is a point graph describing the burst factor vs fractionated rejects content for the test samples of Table I.
Figure 13:
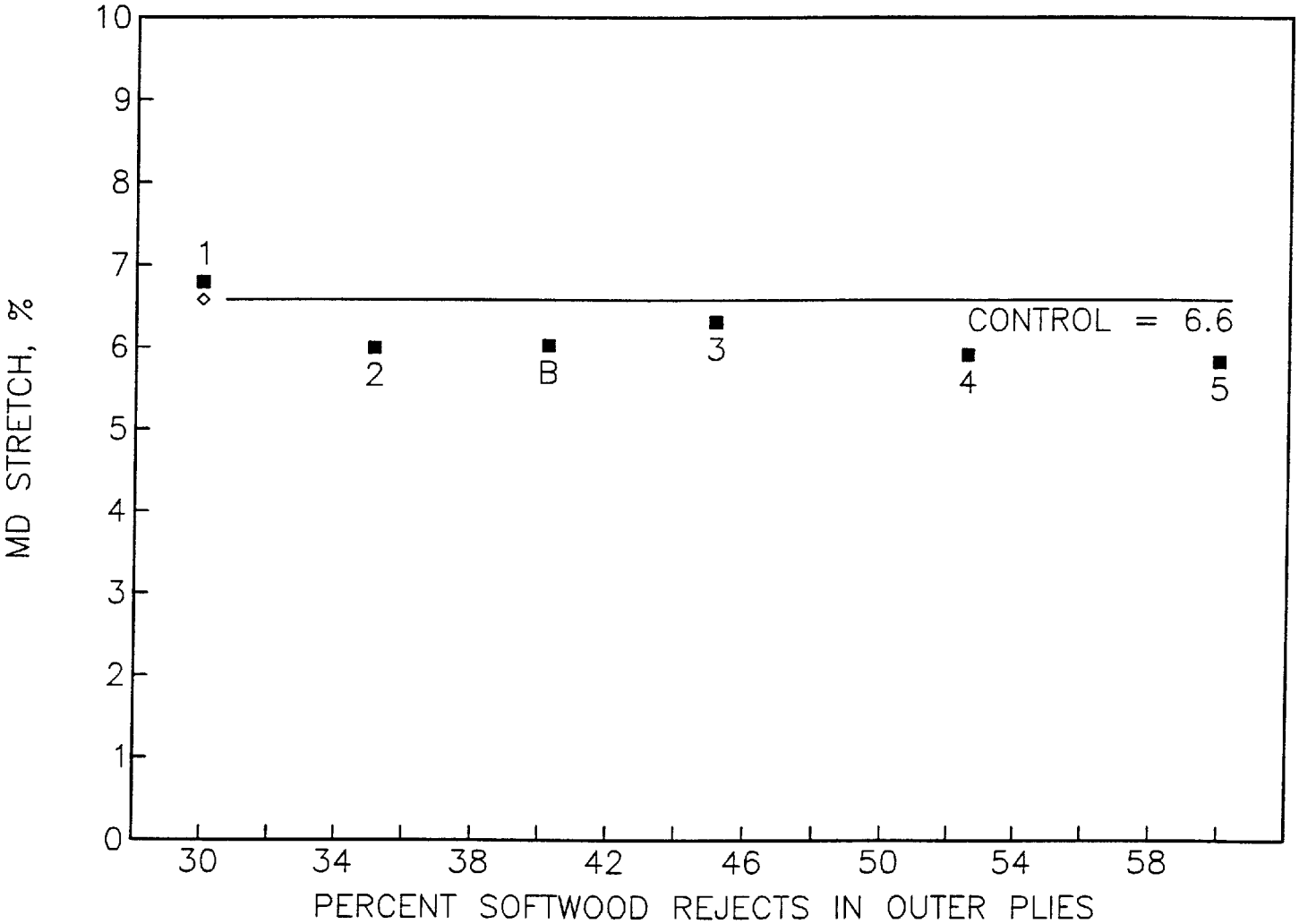
FIG. 13 is a point graph describing the percentage of MD stretch in a present invention sheet vs the fractionated rejects in outer plies.
Figure 14:
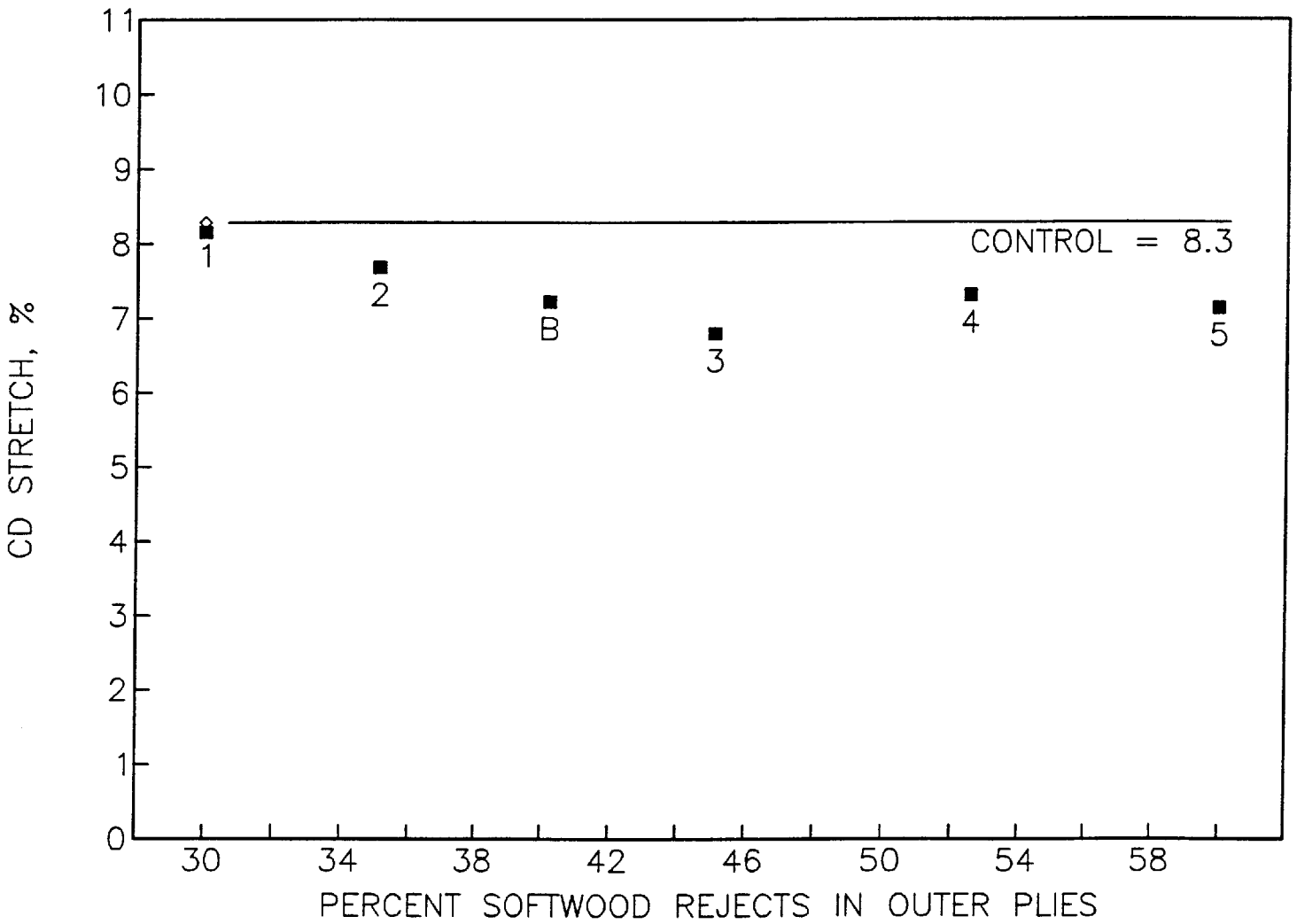
FIG. 14 is a point graph describing the CD stretch properties vs the percentage of fractionated softwood rejects in outer plies.

The bonding-dependent strength properties include the MD Breaking Length values graphed by FIG. 10, the CD Breaking Length values graphed by FIG. 11, the Burst Factor values of FIG. 12, the MD Stretch values of FIG. 13 and the CD Stretch values of FIG. 14. All of these values decreased in comparison with their respective unscreened control sample A values. However, the remixed control sample B also showed decreases in these properties. Breaking length decreased by 14% in the machine direction from 9.3 to 8.0 km and by 13% in the cross-machine direction, from 3.8 to 3.3 km. However, the remixed control sample B had 10% lower Tensile Strength in both the machine direction (8.4 km) and the cross-machine direction (3.4 km) as compared with the unscreened control sample A. FIG. 12 reports that Burst Factor decreased by 12% from 58 to 51. However, the burst resistance of the remixed control sample B was 5% lower than the unscreened control sample A. Stretch decreased by 12% in the machine direction from 6.6% to 5.8% and by 18% in the cross-machine direction from 8.3% to 6.8%. However, the stretch of the remixed control sample A was 9% lower in the machine direction (6.0%) and 13% lower in the cross-machine direction (7.2%). The decreases in these bonding properties are not considered to be important.

Figure 15:
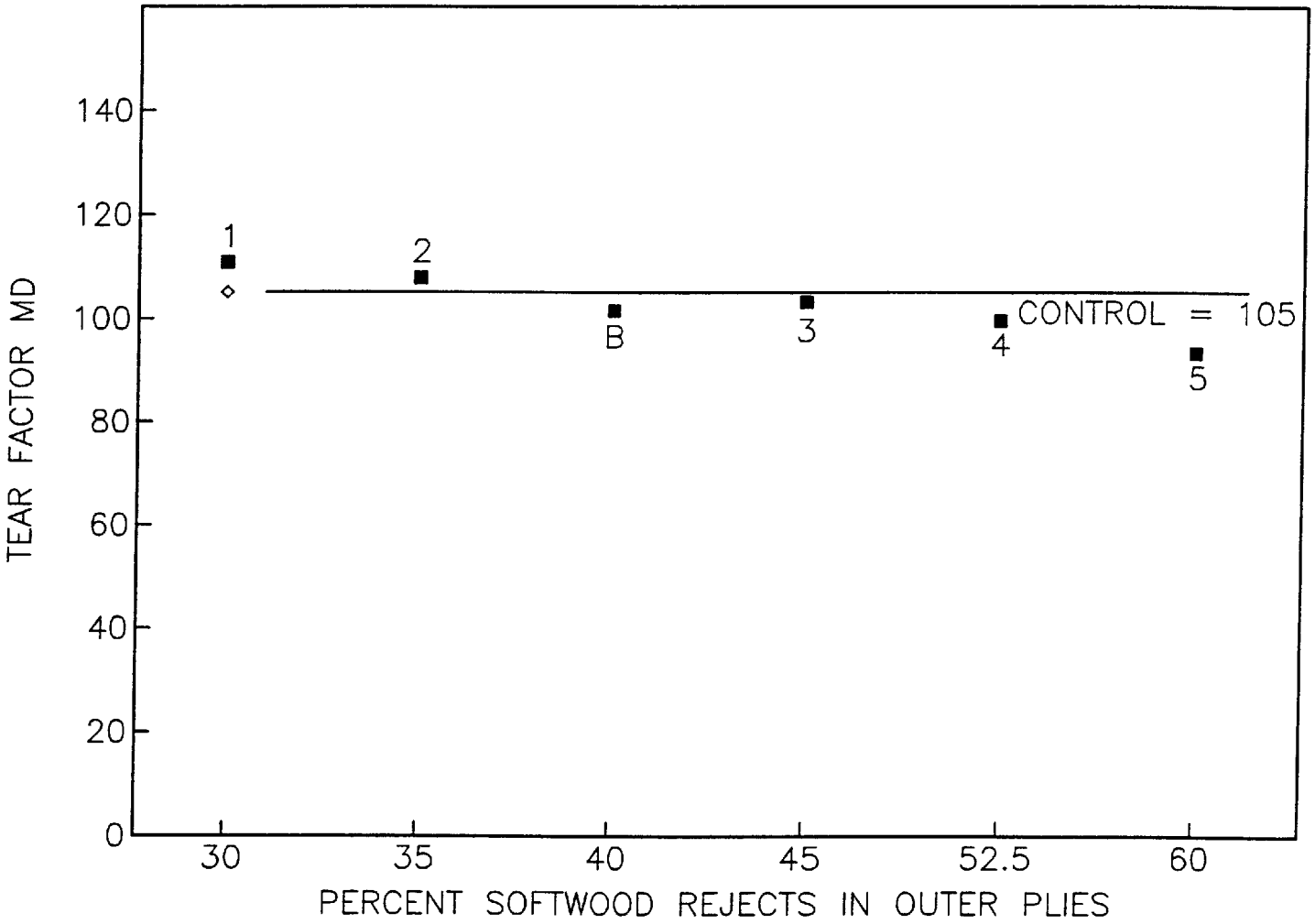
FIG. 15 is a point graph describing the MD Tear factor vs the percentage of fractionated softwood rejects in outer plies.
Figure 16:
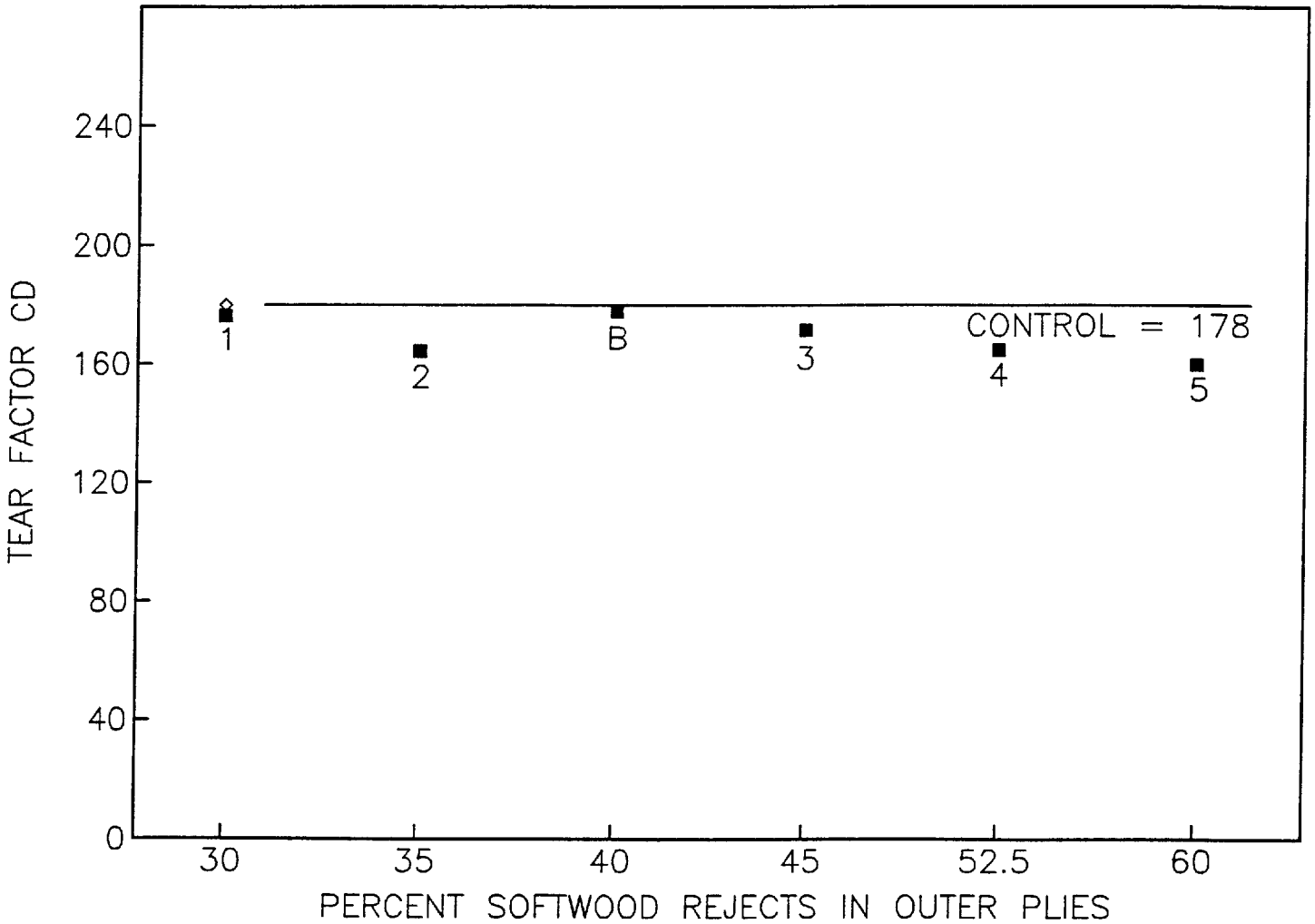
FIG. 16 is a point graph describing the CD Tear factor vs the percentage of fractionated softwood rejects in outer plies.

The Tear Factor values of FIG. 15 (MD) and FIG. 16 (CD) show insignificant decreases as a result of fiber repositioning. Control sample A Tear Factors were 105 in the machine direction and 178 in the cross-machine direction. Tear Factor of the remixed control samples B differed insignificantly (2% to 3%) from the unscreened control samples A.

Figure 17:
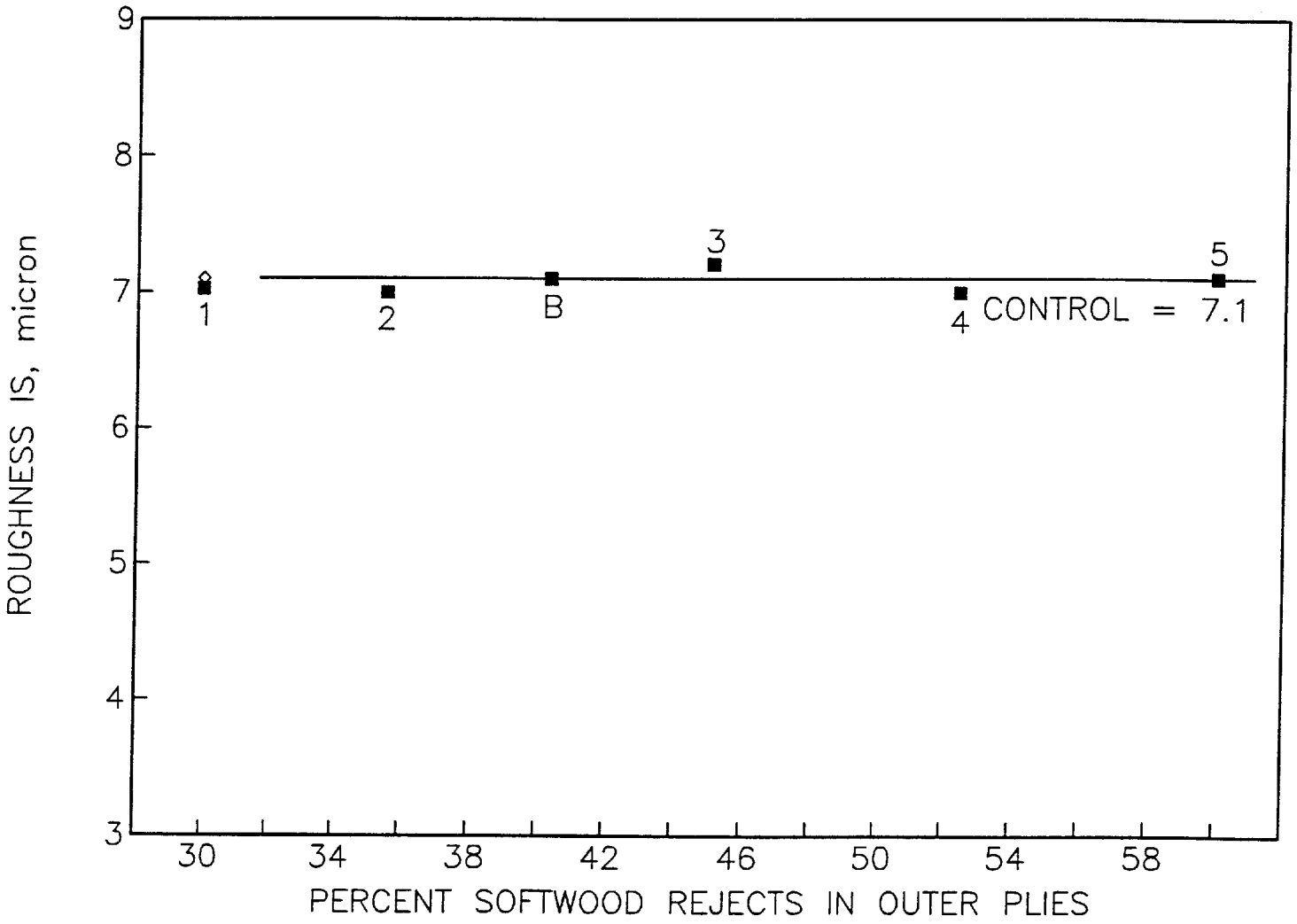
FIG. 17 is a point graph describing the Parker Roughness of inside surfaces vs the percentage of fractionated softwood rejects in outer plies.
Figure 18:
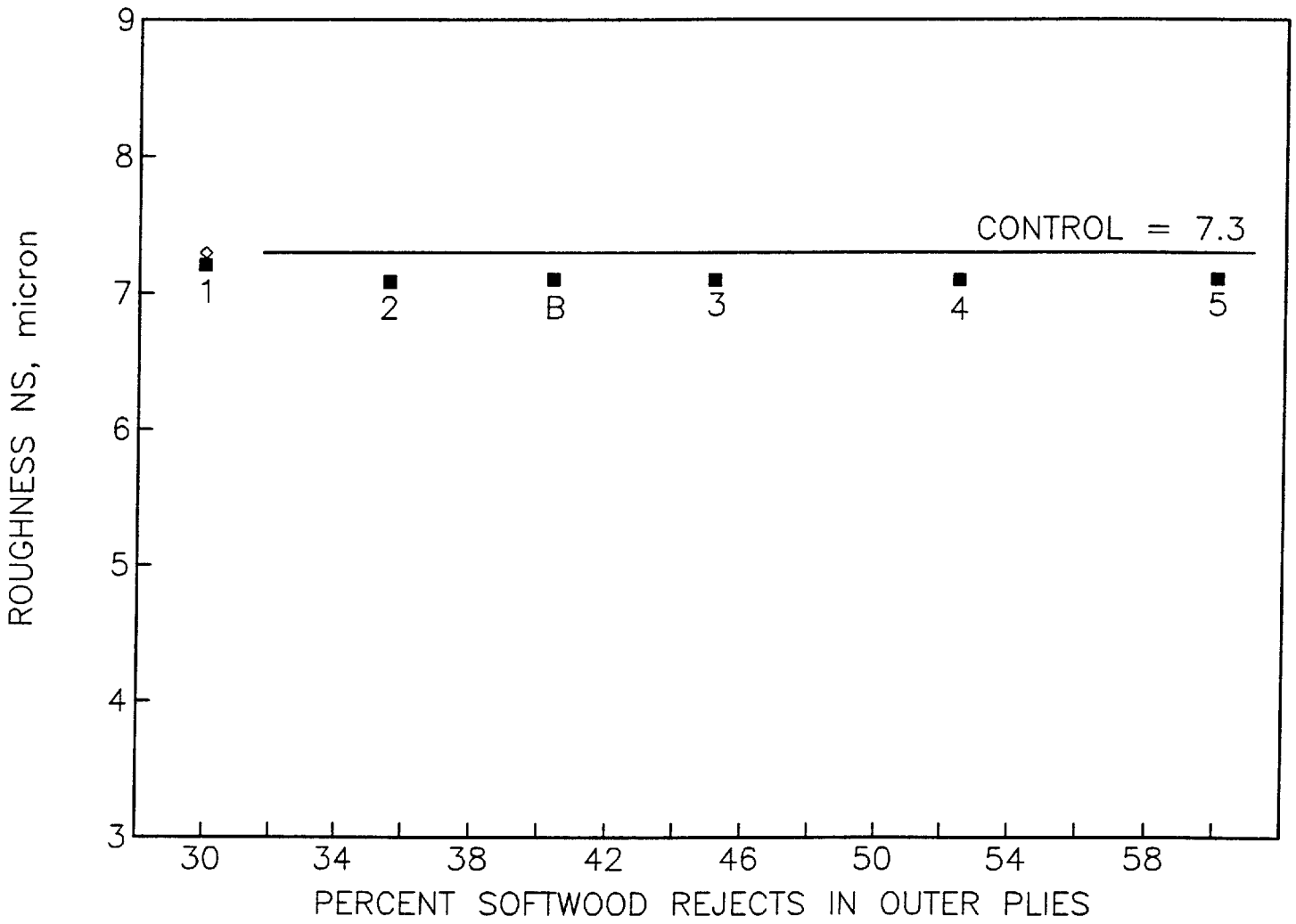
FIG. 18 is a point graph describing the Parker Roughness of outside surfaces vs the percentage of fractionated softwood rejects in outer plies.

FIG. 17 graphs the Parker Roughness values for the sample sheet "inside" surfaces (IS) which are those sheet surfaces that are formed on the side opposite from the web forming wire. FIG. 18 graphs the Parker Roughness values for the "outside" (NS) or wire side of the sample sheets. From an unscreened control sample value of 7.1 for the IS value and an unscreened control sample of 7.3 for the NS value, it will be noted that the test samples did not change significantly. Moreover, the remixed control samples B differed only 3% from the unscreened control samples.

TABLE II

| SAMPLE | | FRACT'N | % BCTMP | MD TABER STIFFNESS | % CHANGE |
|---|---|---|---|---|---|
| 1 | A | N | 0 | 254 | |
| | B | Y | 0 | 285 | 12 |
| 2 | A | N | 10 | 270 | |
| | B | Y | 10 | 300 | 11 |
| 3 | A | N | 25 | 311 | |
| | B | Y | 25 | 319 | 3 |
| 4 | A | N | 25 | 278 | |
| | B | Y | 25 | 323 | 16 |
| 5 | A | N | 25 | 294 | |
| | B | Y | 25 | 320 | 9 |
| 6 | A | N | 25 | 294 | |
| | B | Y | 25 | 276 | −6 |
| 7 | A | N | 25 | 288 | |
| | B | Y | 25 | 289 | 0 |
| 8 | A | N | 25 | 329 | |
| | B | Y | 25 | 352 | 7 |

A second embodiment of the invention addresses further stiffness enhancements by the blended integration of modified mechanical pulp such as bleached chemithermomechanical pulp (BCTMP) into the middle ply of a three-ply paperboard laid predominately from a fractionated softwood kraft pulp. To isolate any stiffness improvement due to fractionation alone, which has already been established, tests were conducted with different pulp sources. The data of these tests are presently by TABLE II and FIGS. 19 and 20.

With respect to TABLE II, the reference or control sample 1-A was a 195 lb/ream (3000 $ft^2$) solid sheet laid from unfractionated softwood kraft pulp. Sample 1-B was the same softwood kraft pulp source as the control sample except that the pulp had been fractionated to provide a 195 lb., three-ply sheet with a center ply having 50% of the pulp weight but laid from the short fiber accepts of the fractionation screen. The two outer plies, each representing 25% of the total sheet weight, were laid entirely with the fractionator rejects. The control sample 1-A included no BCTMP and no fractionated pulp. The MD stiffness of the sample, 254 Taber, is graphed in FIG. 20 as the right hand bar. The fractionated control sample 1-B produced a 285 Taber Stiffness for a 12% stiffness improvement. This improvement is plotted on the ordinate of FIG. 19.

Sample 2-A of TABLE II was a three-ply sheet in which the middle ply comprised a blend of the same softwood kraft of sample 1 and BCTMP. The quantity of BCTMP was about 10% of the entire sheet basis weight or 20% of the middle ply furnish mix. The outer plies of the 2-A sample, 25% of the sheet basis weight, each, were laid from the same, unfractionated softwood kraft. The resulting sample 2-A MD stiffness was 270 Taber.

Sample 2-B differed from sample 2-A in that the softwood kraft was fractionated. The outer-plies of the three-ply, 2-B sample were laid of long fiber fractionator rejects. The sample 2-B center ply comprised a blend of 80% fractionator accepts and 20% BCTMP (10% of sheet total). This fractionated, 10% BCTMP sample 2-B provided a 300 Taber stiffness. The 11% increase in the sample 2-B stiffness value is plotted on FIG. 19.

Samples 3-A and 3-B of TABLE II were similar to samples 2-A and 2-B except that the BCTMP content of the middle ply comprised 25% of the total sheet weight or 50% of the middle ply constituency. From the TABLE, sample 3-A provided a 311 MD Taber stiffness value whereas sample 3-B provided 319 MD Taber stiffness value for a 3% improvement. The sample 3-A and 2-B stiffness values are plotted as the two left-side bars of FIG. 20 and in the 25% abscissa plane of FIG. 19.

Samples 1 through 3 were each prepared with the same virgin softwood kraft pulp stock. Samples 2-A and 3-A were blended with the same BTCMP stock. Samples 4 through 8, however, were each blended with respective virgin softwood kraft pulp stocks. The BTCMP stock for samples 4-B through 8-B was the same as for the 2-B and 3-B samples.

Figure 19:
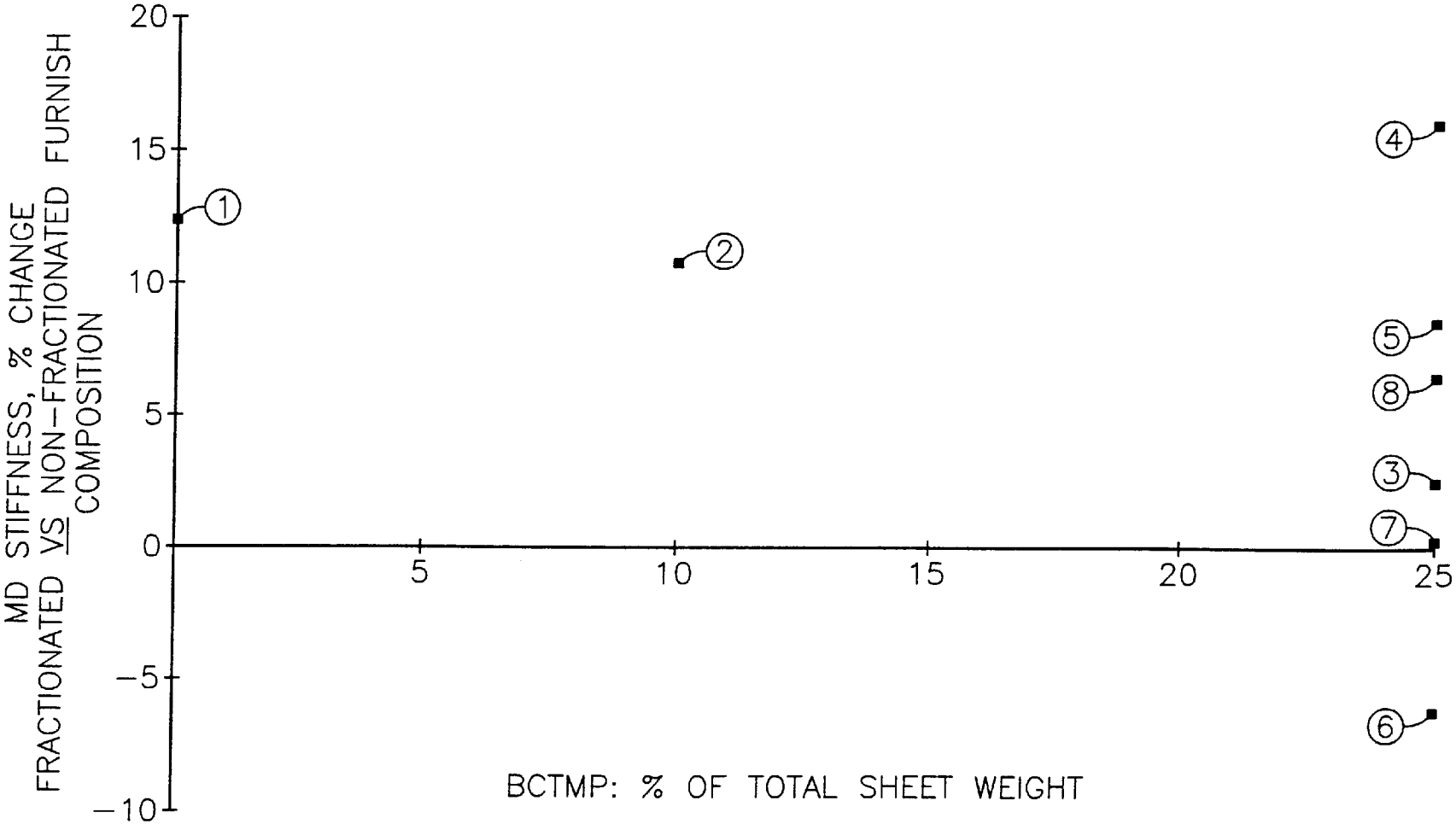
FIG. 19 is a point graph describing the test data of Table II respective to MD stiffness change vs the integration of bleached chemithermomechanical pulp (BCTMP) as a percentage of total sheet weight.

This difference of virgin kraft pulp sources will account for some of the wide variance seen from the TABLE II % change data and the graphic display of that data by FIG. 19. These differences encompass a span from a 16% stiffness improvement for the fractionated sample 4-B over sample 4-A to a 6% loss of stiffness by fractionated sample 6-B compared to unfractionated sample 6-A. In the overall average, however, the fractionated 25% BCTMP samples provided a 5% stiffness improvement over the unfractionated samples. At the lower level of 10% BCTMP substitution, fiber fractionation contributes an estimated 10% to the board stiffness: equivalent to about 2% potential decrease in basis weight.

TABLE III

| Sample | Fraction-ation | BCTMP % | Taber MD est @ 195 | % Increase | Basis Weight | % Decrease |
|---|---|---|---|---|---|---|
| | Control | 0 | 254 | 0 | 195 | 0 |
| Fract'n only | Yes | 0 | 285 | 12 | 189 | 3 |
| BCTMP only | No | 10 | 340 | 30 | 185 | 5 |
| Fract'n & BCTMP | Yes | 10 | 370 | 40 | 181 | 7 |
| BCTMP only | No | 25 | 430 | 65 | 172 | 12 |
| Fract'n & BCTMP | Yes | 25 | 440 | 70 | 170 | 13 |

TABLE III data represents a summarization and averaging of the TABLE II data to focus the observation that fiber fractionation alone, without any BCTMP substitution, was estimated to add about 12% to board stiffness: equal to about 3% potential decrease in basis weight. Substitution of 10% total sheet basis weight of BCTMP into the center ply, with no softwood fractionation, contributes about 30% to the board stiffness: corresponding to about 5% potential total basis weight reduction. When fractionation contributions are combined with the 10% BCTMP contributions, the stiffness improvements rise to 40%: corresponding to about 7% potential total basis weight reduction.

For the 25% total sheet basis weight substitution of BCTMP into the center ply furnish, without fractionation of the softwood, stiffness is seen to increase 65% over the control paperboard: corresponding to about 12% potential for total basis weight reduction.

Finally, for the combined effects of both softwood fractionation and integration of 25% total basis weight BCTMP with the center ply furnish, the MD Taber stiffness is seen to increase 70%: corresponding to about 13% potential for total basis weight reduction.

Figure 20:
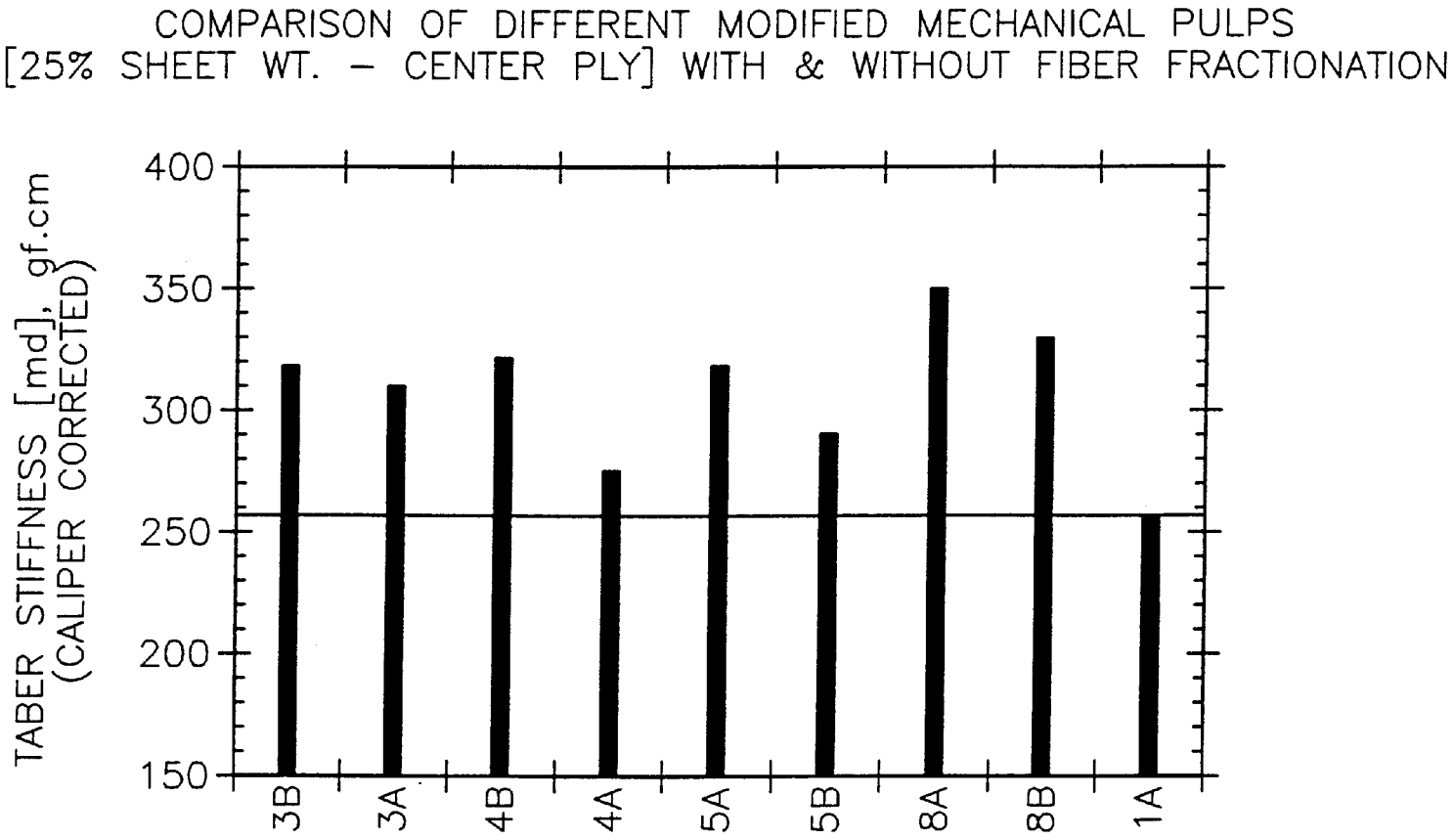
FIG. 20 is a bar graph describing the MD Taber stiffness values of Table II for 25% BCTMP sheet weight in a center ply with no fractionation.

It should be observed from the FIG. 20 bar graph that all of the 25% BCTMP blended samples produced greater stiffness values for the same basis weight than the solid kraft sample 11-A.

Figure 21:
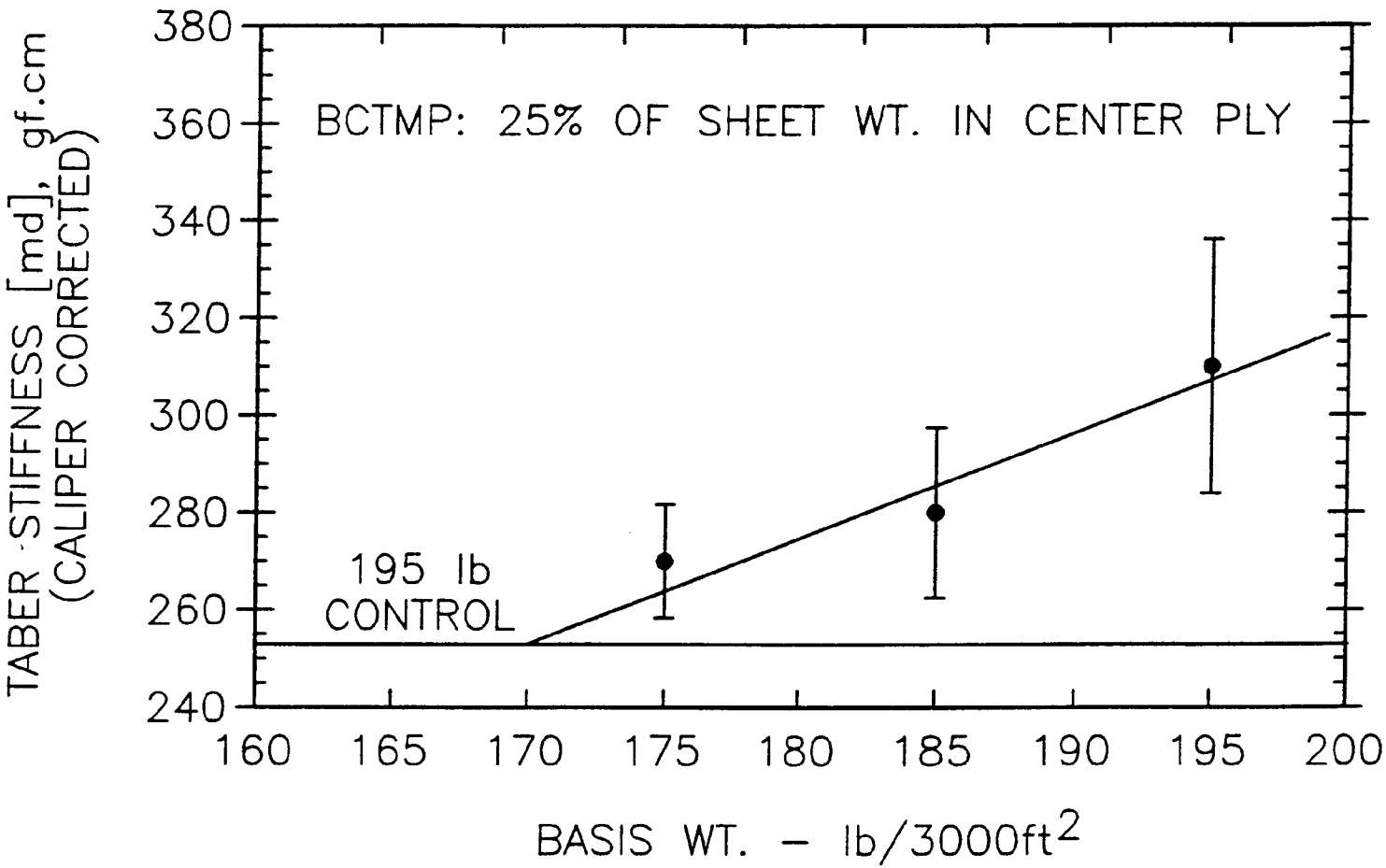
FIG. 21 is a comparison graph of MD Taber stiffness properties for three different basis weight examples of three-ply sheet having 25% BCTMP in the center ply.

In order to further estimate the potential for basis weight reduction and, hence, raw material cost savings, for production of a three-ply paperboard web having stiffness properties corresponding to the 195 lb/3000 $ft^2$ control, hand sheets of different basis weights but of the same composition as the TABLE II samples were tested. The Taber MD stiffness data of these tests is graphically represented by FIG. 21 to indicate that a 170 lb/3000 $ft^2$ sheet made with 25% modified mechanical pulp (BCTMP) in the center ply provides a stiffness equivalent to a 195 lb/3000 $ft^2$ all kraft control sheet. This extrapolation represents a basis weight reduction (yield increase) of 13%.

Figure 22:
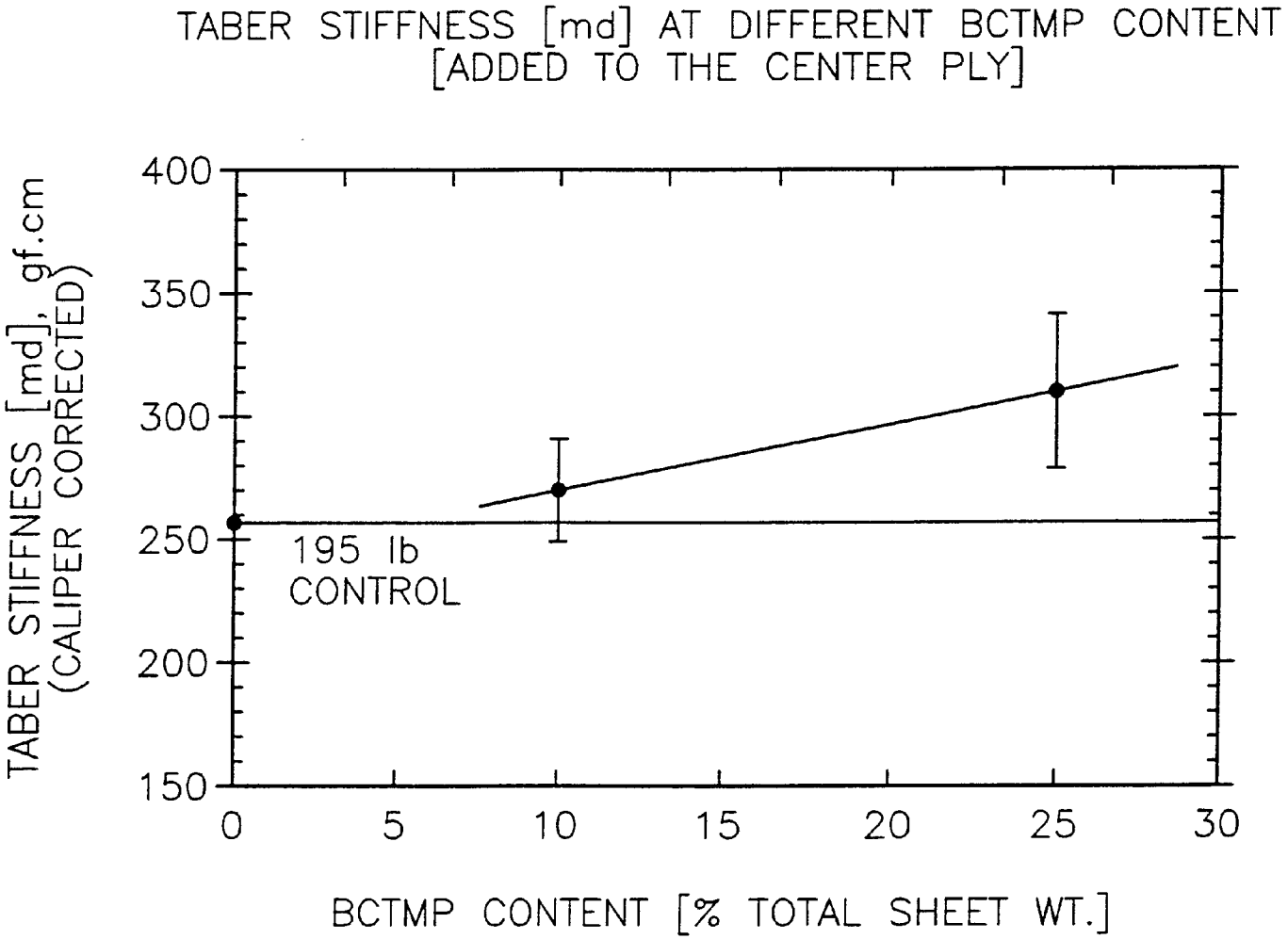
FIG. 22 is a comparison graph of MD Taber stiffness properties vs 10% and 25% BCTMP content.

FIG. 22 reports a comparative summary of data respective to stiffness contributions, independently of fiber fractionation, by modified mechanical pulp constituencies of 10% and 25% of the sheet total basis weight.

A third permutation of the invention involves the optional blending and balancing of fractionated pulp with modified mechanical pulp respective to the core ply and outer plies of a multi-ply paperboard. Raw pulp stock for a mixed species paperboard furnish is usually bleached along independent, species distinctive, bleach processing lines i.e. separate bleach lines for hardwood and softwood. Functionally, however, short softwood fiber may be effectively bleached in the hardwood bleach line as an integrated constituent of the hardwood flowstream. Traditionally, pulp screening of knots and shives is performed prior to bleaching for the simple economic motive of avoiding the investment of bleach expense on fiber that will be ultimately culled from the flowstream. Fractionation screening however, is not a culling process, but a repositioning process. All of the fractionated pulp ultimately finds its way into a paper machine furnish. Relative to the bleach sequence, therefore, fractionation may be performed either before or after bleaching. As will be seen, however, there is a difference with respect to the product stiffness.

As previously developed, screen fractionation of bleached softwood, moving the longer "reject" fibers into the outer plies and moving the shorter "accept" fibers into the center ply of a multi-ply paperboard, increases the board stiffness by 12% to 15%. This third permutation of the invention pursues the premise that board stiffness may be further increased if more softwood is available for screening relative to the available hardwood. Increased stiffness by tilting the softwood/hardwood ratio toward an increased proportion of softwood also introduces an opportunity for a basis weight reduction and a yield increase.

Figure 23:
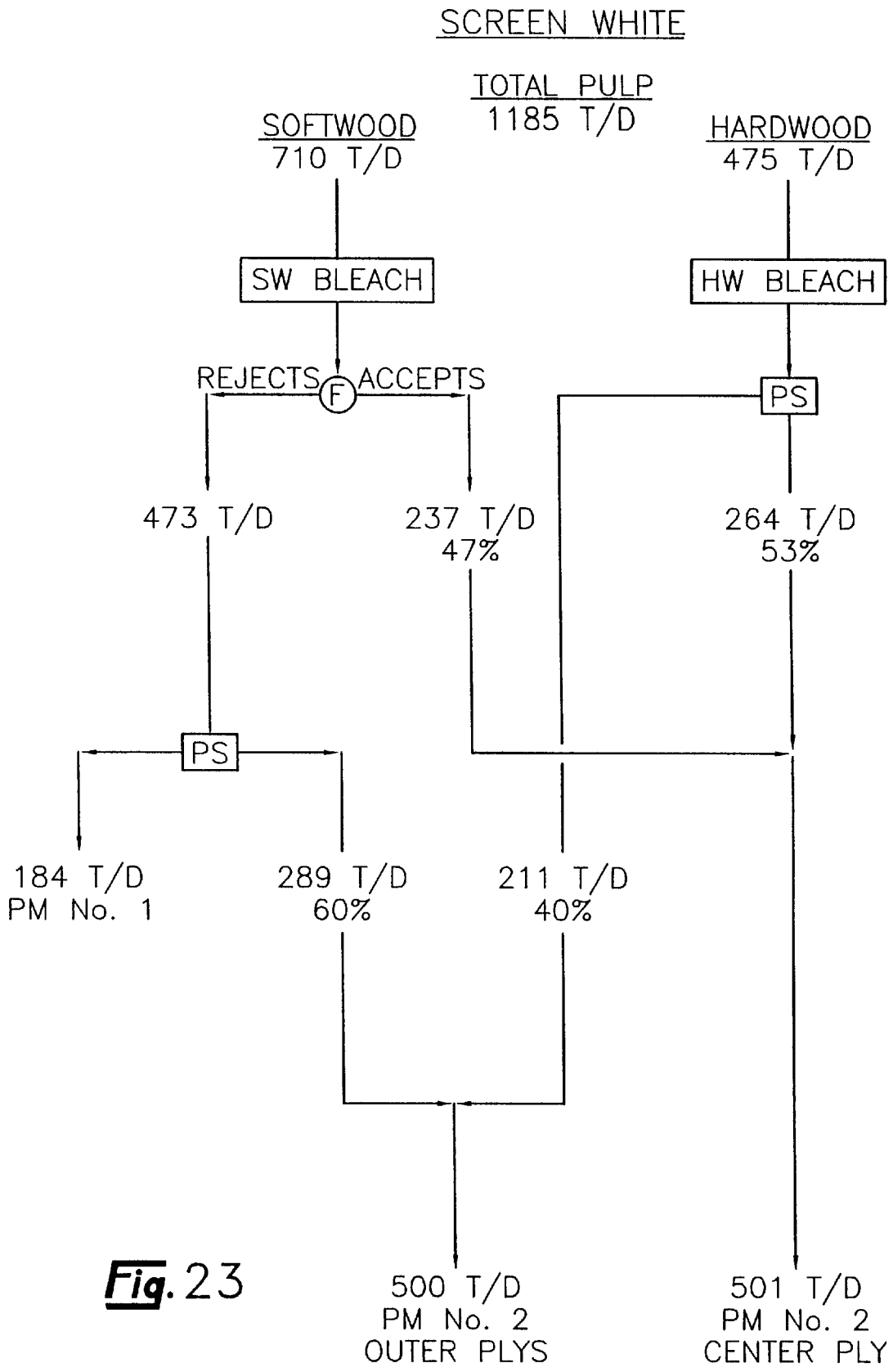
FIG. 23 is a schematic flow diagram respective to a first aspect of a second invention embodiment.
Figure 24:
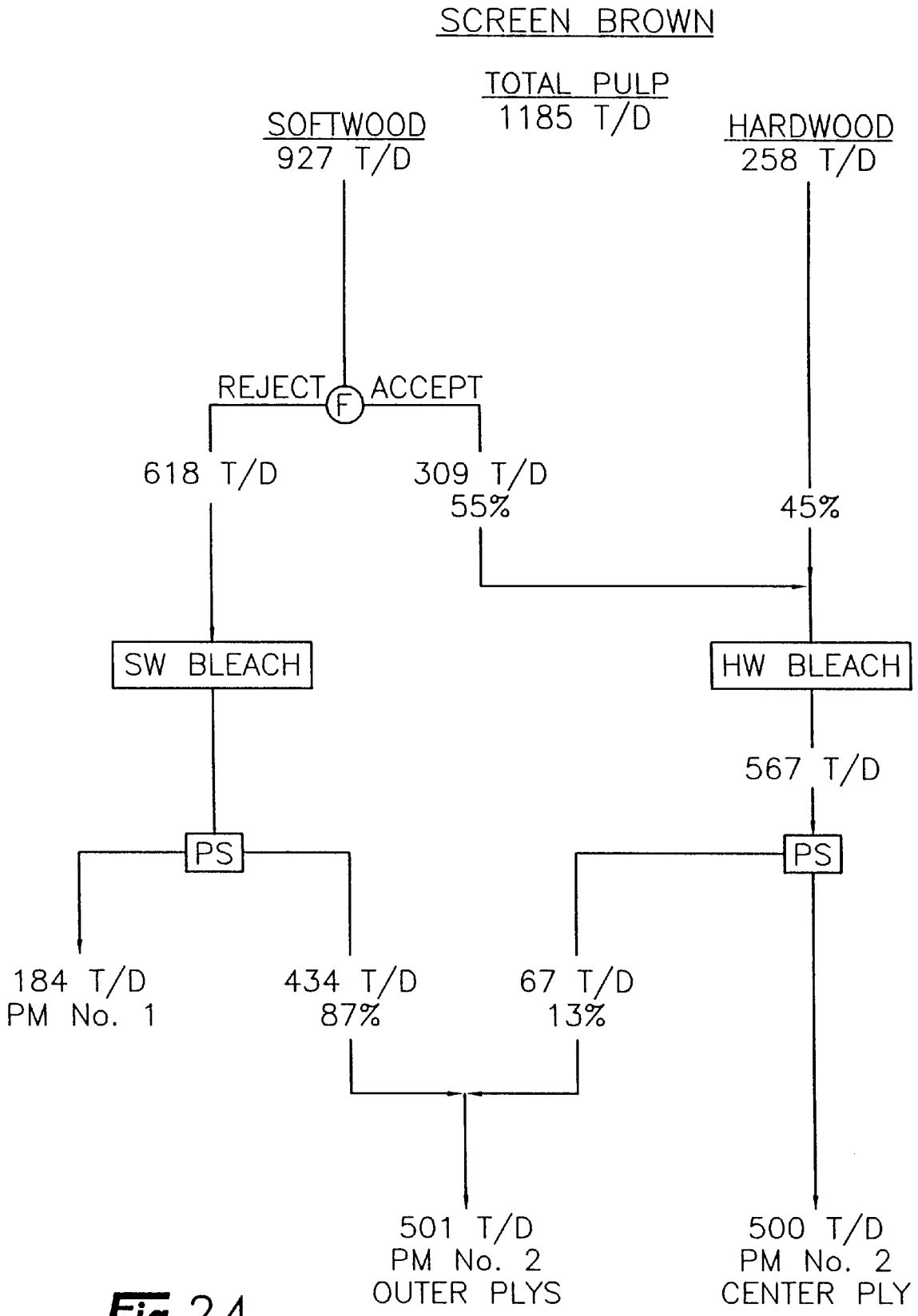
FIG. 24 is a schematic flow diagram respective to a second aspect of the second invention embodiment.

For comparative analysis, two pulp stock preparation examples are described and schematically illustrated by FIGS. 23 and 24 as "screen white" and "screen brown", respectively.

In the "screen white" example of FIG. 23, 710 tons per day of softwood are sequentially bleached and fractionated. 473 T/D of long fiber "rejects" and 237 T/D of short fiber "accept" are the product. Of this quantity, 184 T/D of the long fiber rejects fraction are dedicated to other applications represented as paper machine No. 1. This No. 1 dedicated reject fraction is separated from the 289 T/D remaining reject fraction by a pipe split.

The 273 T/D accept softwood fraction is mixed with 264 T/D of bleached hardwood coming from a pipe split of 475 T/D post bleach hardwood. 211 T/D of bleached hardwood are mixed with the 289 T/D of softwood rejects for 500 T/D of mixed, outer ply furnish to the No. 2 paper machine. The 289 T/D of softwood rejects constitutes 60% of the outer ply furnish for a three-ply sheet whereas the 211 T/D of bleached hardwood constitutes 40% of the outer ply furnish. The combined 289 T/D of softwood rejects and 211 T/D of bleached hardwood represents 50% (500 T/D) of the 1001 T/D three-ply sheet basis weight.

The other 50% (501 T/D) of the three-ply sheet basis weight is mixed from a combination of the 264 T/D of bleached hardwood and 237 T/D of bleached softwood accepts as furnish for the center ply of the sheet. The bleached hardwood constitutes 53% of the center ply whereas bleached softwood accept constitutes the remaining 47% of the center ply.

The "screen brown" product of the FIG. 24 process is also a bleached, 1001 T/D basis weight, balanced three-ply sheet wherein about 50% of the fiber is laid into the center ply and the other 50% divided substantially equally between the two outer plies, about 25% each. Starting with a combined pulp flow of about 1185 T/D as the total of 927 T/D of unbleached softwood and 258 T/D of unbleached hardwood, the unbleached softwood flowstream is fractionated to produce about 618 T/D of long fiber rejects and 309 T/D of short fiber accept. The 618 T/D rejects flow stream is bleached. Subsequently, the post bleached rejects flow stream is divided to separate the 184 T/D of bleached, long fiber for paper machine No. 1 as in the screen white example. The remaining 434 T/D of bleached, long fiber rejects constitutes 87% of the 501 T/D outer ply flow to the multi-ply headbox of No. 2 paper machine.

The unbleached 258 T/D hardwood pulp supply is mixed with the 309 T/D of unbleached softwood accept as a 45%/55% pulp blend into the hardwood bleach line. The 567 T/D bleached mixture from the hardwood bleach line is divided by a pipe split. 67 T/D of the bleached mixture of 55% softwood accept and 45% hardwood is mixed with the 434 T/D bleached softwood rejects as a 501 T/D furnish flow to the No. 2 machine outer ply headbox. The remaining 500 T/D of bleached hardwood/softwood accept mixture constitutes the center ply headbox furnish.

The product of these FIGS. 23, 24, 25 and 26 stock preparation examples was laid in 3 lb/rm, 185 lb/rm and 195 lb/rm basis weight sheets for MD and CD Taber stiffness testing. For comparison and control, MD and CD Taber stiffness data was taken for a solid, unfractionated, bleached softwood kraft sheet of 195 lb/rm basis weight and 18.22 mil caliper. This data is presented by Tables IV and V and the bar graph of FIG. 27.

TABLE IV

Figure 25:
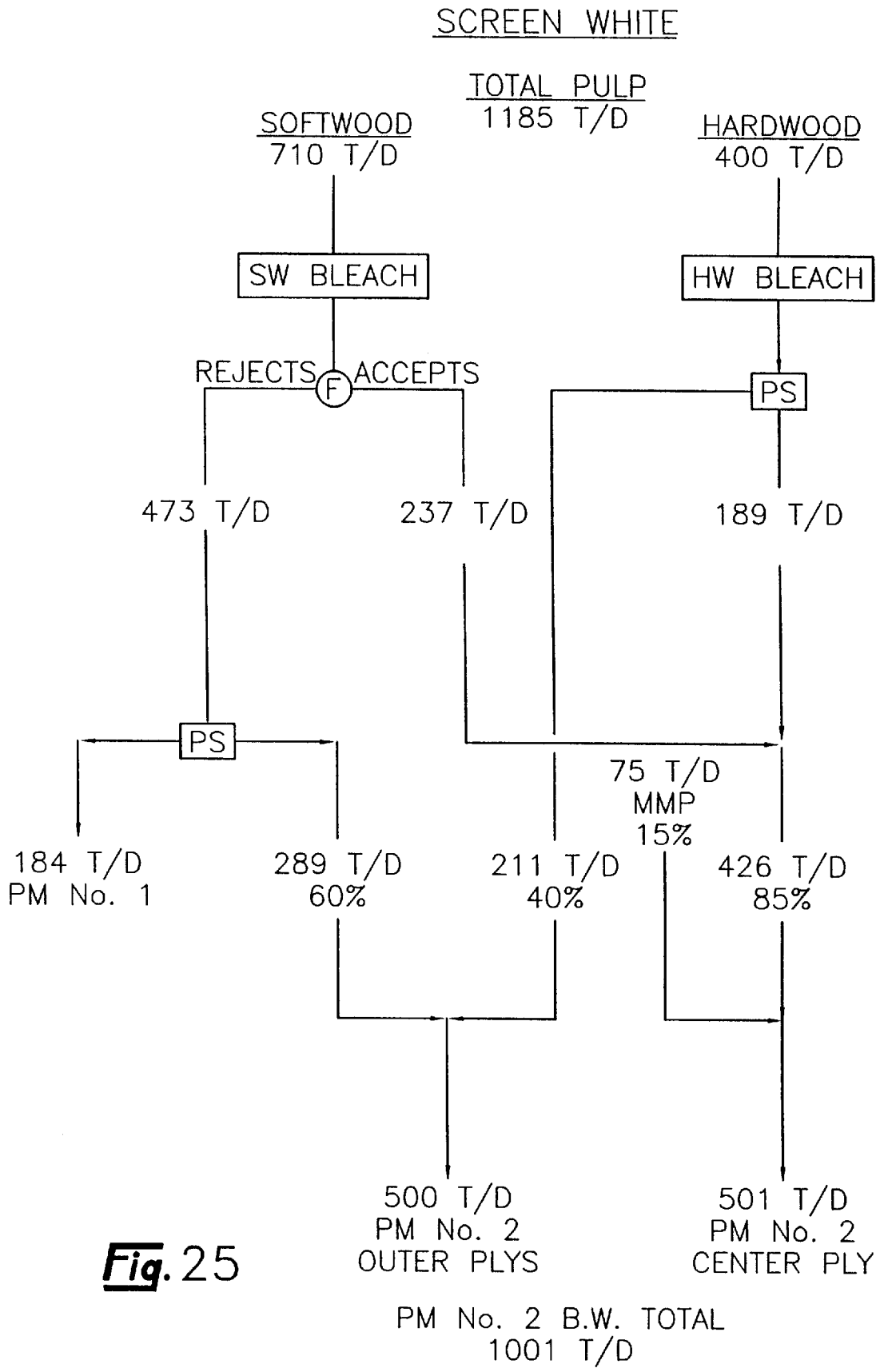
FIG. 25 is a schematic flow diagram respective to a first aspect of the third invention embodiment.
Figure 26:
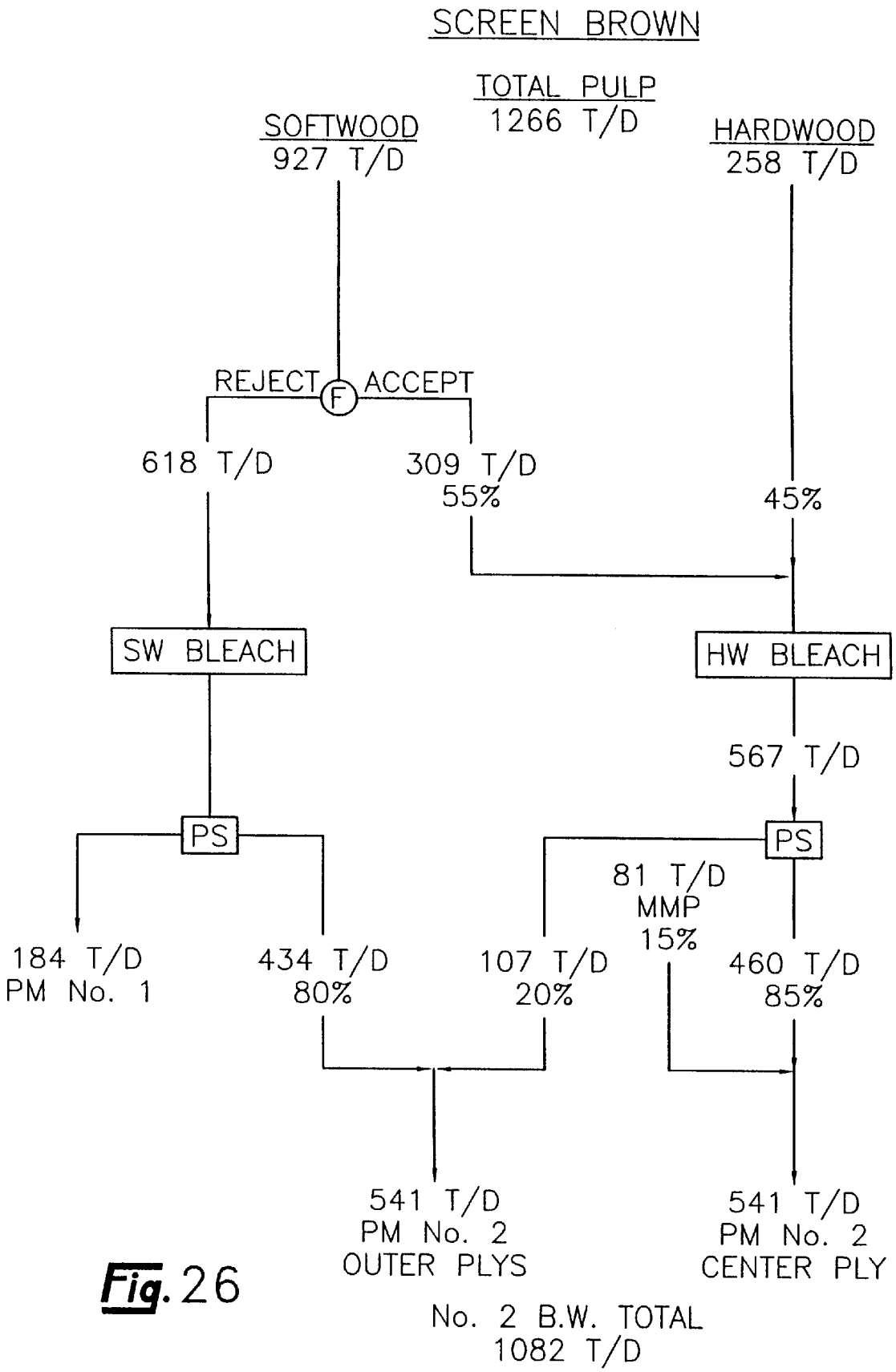
FIG. 26 is a schematic flow diagram respective to a second aspect of the third invention embodiment; and, FIG. 27 is a comparative bar graph of MD Taber stiffness values vs three different total sheet basis weights respective to each of the two aspects of the second and third invention embodiments.

| Basis Weight, #/rm | Caliper, mil | Taber Stiffness, CD | Taber Stiffness, MD | Sample |
|---|---|---|---|---|
| 195 | 18.22 | 104 | 262 | Control |
| 195 | 19.03 | 108 | 281 | FIG. 23 |
| 185 | 17.49 | 113 | 295 | SCREEN WHITE |
| 175 | 15.90 | 100 | 223 | |
| 195 | 20.09 | 133 | 284 | FIG. 25 |
| 185 | 18.26 | 113 | 295 | SCREEN WHITE |
| 175 | 17.70 | 111 | 235 | & MMP-15% of mid-ply |
| 195 | 18.11 | 120 | 259 | FIG. 24 |
| 185 | 17.44 | 128 | 292 | SCREEN BROWN |
| 175 | 16.75 | 113 | 269 | |
| 195 | 19.09 | 140 | 316 | FIG. 26 |
| 185 | 18.85 | 136 | 292 | SCREEN BROWN |
| 175 | 17.05 | 112 | 277 | & MMP-15% of mid-ply |

TABLE V

| Basis Weight, lb/rm | Caliper, mil | Taber Stiffness, CD | Taber Stiffness, MD | Sample |
|---|---|---|---|---|
| 195 | 18.22 | 104 | 262 | Control |
| 195 | 19.03 | 118 | 307 | FIG. 23 |
| 185 | 17.49 | 108 | 233 | SCREEN WHITE |
| 175 | 15.9 | 82 | 183 | |
| 195 | 20.09 | 159 | 338 | FIG. 25 |
| 185 | 18.26 | 116 | 302 | SCREEN WHITE |
| 175 | 17.70 | 108 | 229 | & MMP-15% of mid-ply |
| 195 | 18.11 | 121 | 262 | FIG. 24 |
| 185 | 17.44 | 122 | 278 | SCREEN BROWN |
| 175 | 16.75 | 101 | 240 | |
| 195 | 19.09 | 154 | 347 | FIG. 26 |
| 185 | 18.85 | 146 | 314 | SCREEN BROWN |
| 175 | 17.05 | 103 | 254 | & MMP-15% of mid-ply |

The fourth permutation of the invention evolves from the third permutation and is represented by the stock preparation processes diagramed by the flow schematics of FIGS. 25 and 26. The primary difference between the third permutation processes of FIG. 23 and 24 and fourth permutation process of FIG. 25 and 26 is the 15% modified mechanical pulp, (MMP) which in this case is bleached chemithermomechanical pulp (BCTMP), mixed with center ply furnish constituency.

The screen white process of FIG. 25 differs from the screen white process of FIG. 23 by a reduction in the hardwood raw stock supply by 75 tons/day and adding that amount of MMP to the 426 tons/day supply of bleached mixture of hardwood and softwood accepts to the No. 2 paper machine center ply furnish.

Adjustment of the screen brown process of FIG. 26 to accommodate a 15% modified mechanical pulp constituency in the center ply furnish is a bit more involved to maintain a corresponding balance between the center ply and outer ply basis weights. Basically, the total pulp mill production rate is increased by the 15% addition of modified mechanical pulp which, in this example amounts to 81 tons/day or 6.4% of the total pulp flow. However, because the increase is with groundwood rather than digested chips, there is no increase in the digestion production or recovery loading.

It is noted that in the flow process of FIG. 26 the raw digested stock flow remains the same at 927 tons/day softwood and 258 tons/day hardwood. Accordingly the 55%/45% mix of fractionated unbleached softwood accept and raw unbleached hardwood pulp remains the same as the FIG. 24 process. However, following the hardwood bleach line the mixed bleached pulp stream of 567 tons/day is divided with 107 tons/day going to the outer ply headbox furnish. Blended with the 434 tons/day of bleached softwood rejects, the 107 tons/day of accepts/hardwood mixture comprises about 20% of the outer ply furnish. Bleached softwood rejects provides the dominant 80% of the outer ply furnish. Comparatively, the FIG. 24 process outer ply constituency was 87% bleached softwood rejects and 13% mixed accept/hardwood pulp.

With respect to the FIG. 26 screen brown center ply constituency, the remaining 460 tons/day of bleached, accept/hardwood mixture is further mixed with 81 tons/day (15%) of modified mechanical pulp (BCTMP) for a 541 tons/day center ply furnish flow.

The total pulp flow rate to the multi-ply No. 2 machine is 1082 tons/day which is 81 tons/day greater than the screen brown process of FIG. 24.

Like the FIGS. 23 and 24 process products, three-ply sheet examples from the FIGS. 25 and 26 processes were laid to 175 lb/rm, 185 lb/rm and 195 lb/rm basis weights for MD and CD Taber stiffness testing. The data developed from these tests is also tabulated by TABLES IV and V and the bar graph of FIG. 27.

Figure 27:
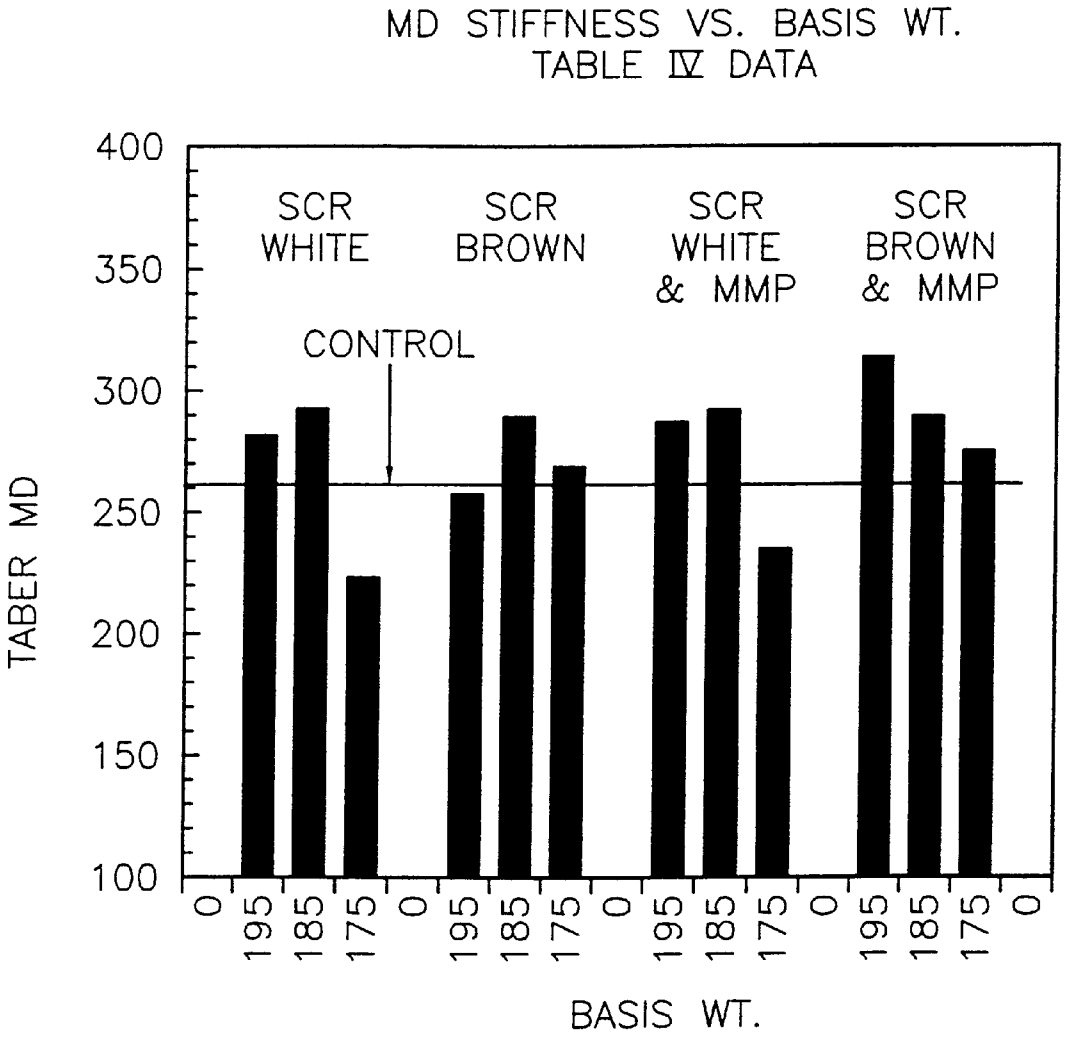

Each basis weight data set represents the average of test results taken from numerous individual sheets that were formed to the respective basis weight from a particular stock blend. Sheet caliper at the respective basis weight was variable. The solid bleached and unfractioned kraft pulp control sample was the same for the test runs respective to each of TABLE IV and TABLE V. Otherwise, TABLES IV and V present data respective to separate pulp test runs. The bar graph of FIG. 27 presents only the TABLE IV data.

TABLE VI

| OPTION | | YIELD INCREASE MD | YIELD INCREASE CD |
|---|---|---|---|
| FIG. 23 SCREEN WHITE | | 3% | 5% |
| FIG. 24 | SCREEN BROWN | 10+% | 10+% |
| | YIELD ADVANTAGE (BROWN vs. WHITE) | 7 | 5 |
| FIG. 25 SCREEN WHITE & MMP | | 7% | 10+% |
| FIG. 26 | SCREEN BROWN & MMP | 10+% | 10++% |
| | YIELD ADVANTAGE (BROWN vs. WHITE) | 3 | — |

TABLE VI summarizes the estimated yield increases respective to each of the third and fourth embodiments of the invention over a reference sheet of corresponding stiffness. In this context, yield increase means that percentage of surface area increase per ton of pulp that is permitted at a given stiffness value over a non fractionated reference. Obviously, the basis weight and/or caliper of the yield increased sheet may change from the reference sheet. The yield increase may be evaluated for either the MD or CD characteristic. Accordingly, the fractionated FIG. 23 process option will provide 3% more paperboard area at the same MD stiffness as a non-fractionated sheet. The screen brown option of FIG. 24 will provide more than 10% greater surface area than the unfractionated screen white option thereby offering a 7% advantage to the FIG. 24 option over the FIG. 23 option.

The foregoing description of preferred embodiments of our invention has been presented for purposes of illustration and description only. It is not intended to be exhaustive or to limit the invention to the precise forms disclosed. Obvious modifications or variations are possible in light of the foregoing teachings. The embodiments were chosen and described to provide the best illustration of the principles of the invention known at this time and its practical application and to thereby enable one of ordinary skill in the art to utilize the invention in various embodiments and with various modifications as is suited to the particular use contemplated. All such modifications and variations are within the scope of the invention as set forth in the appended claims when interpreted in accordance with breadth to which they are fairly, legally and equitably entitled.

We claim:

1. A multi-ply paperboard sheet formed of chemically pulped papermaking fiber having at least one center ply between a pair of surface plies, a substantial portion of fiber in said surface plies being a long fiber fraction of a chemically pulped softwood constituency, said center ply substantially comprising a mixture of chemically pulped hardwood and short fiber fraction of said chemically pulped softwood.

2. A multi-ply sheet as described in claim 1 wherein said surface plies further comprise as a substantial portion thereof, a mixture of chemically pulped hardwood and short fiber fraction of said chemically pulped softwood.

3. A multi-ply sheet as described by claim 1 wherein said surface plies comprise more than about 35% long fiber fraction.

4. A multi-ply sheet as described by claim 3 wherein said surface plies comprise about 60% long fiber fraction.

5. A multi-ply sheet as described by claim 1 wherein said center ply also comprises a substantial portion of modified mechanical pulp.

6. A multi-ply sheet as described by claim 5 wherein about 20% to about 50% of said center ply mixture comprises modified mechanical pulp.

7. A multi-ply sheet as described by claim 1 wherein said chemically pulped softwood and hardwood comprises bleached chemically pulped softwood and hardwood.

8. A multi-ply sheet as described by claim 7 wherein said chemically pulped softwood, chemically pulped hardwood and modified mechanical pulp comprises bleached chemically pulped softwood, chemically pulped hardwood, and modified mechanical pulp.

* * * * *